US007690924B1

(12) United States Patent
Paquette et al.

(10) Patent No.: US 7,690,924 B1
(45) Date of Patent: Apr. 6, 2010

(54) ELECTRICAL CONNECTOR TO CONNECT CIRCUIT CARDS

(75) Inventors: Jeffrey Paquette, Newton, MA (US); Scott R. Cheyne, Brookline, NH (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/421,262

(22) Filed: Apr. 9, 2009

Related U.S. Application Data

(60) Provisional application No. 61/162,769, filed on Mar. 24, 2009.

(51) Int. Cl.
*H01R 12/00* (2006.01)

(52) U.S. Cl. ..... 439/67

(58) Field of Classification Search ..... 439/67, 439/62, 65, 59, 493; 361/784, 787
See application file for complete search history.

(56) References Cited

U.S. PATENT DOCUMENTS 6,480,167 B2 11/2002 Matthews
6,997,720 B2 * 2/2006 Perret et al. ..... 439/67
7,371,090 B2 * 5/2008 Hashizume ..... 439/164
7,374,426 B2 * 5/2008 Akamatsu ..... 439/62

* cited by examiner

*Primary Examiner*—Chandrika Prasad
(74) *Attorney, Agent, or Firm*—Daly, Crowley & Mofford & Durkee, LLP

(57) ABSTRACT

In one aspect, an electrical connector to connect circuit cards includes a compliant member that includes a first end portion and a second end portion, a first rigid member attached to the first end portion of the compliant member and including a first bore extending along an axis, a second rigid member attached to the second end portion of the compliant member and including a second bore extending along the axis and a pin secured in the first bore and configured to move within the second bore. The compliant member is configured to translate along the axis from a first position corresponding to the first and second rigid members being separated to a second position corresponding to the first and second rigid members being in direct contact.

33 Claims, 21 Drawing Sheets

ELECTRICAL CONNECTOR TO CONNECT CIRCUIT CARDS

RELATED PATENT APPLICATION

This application claims priority to provisional application Ser. No. 61/162,769, entitled "ELECTRICAL CONNECTOR TO CONNECT STACKED CIRCUIT CARDS," filed Mar. 24, 2009, which is incorporated herein in its entirety.

BACKGROUND

Sometimes it is desirable to transfer signals (e.g., power signals) from one circuit board to another circuit board. In one example, an interconnection between circuit cards includes a busbar blade and a corresponding busbar blade connector to receive the busbar blade. Generally, the busbar blade interconnection is used for low inductance requirements. In another example, a pin-and-socket connection is used. For example, one part of the interconnection includes a series of pins and another part of the interconnection includes a series of sockets, each socket configured to receive a corresponding pin. Generally, the pin-and-socket connection is used for high current requirements.

SUMMARY

In one aspect, an electrical connector to connect circuit cards includes a compliant member that includes a first end portion and a second end portion, a first rigid member attached to the first end portion of the compliant member and including a first bore extending along an axis, a second rigid member attached to the second end portion of the compliant member and including a second bore extending along the axis and a pin secured in the first bore and configured to move within the second bore. The compliant member is configured to translate along the axis from a first position corresponding to the first and second rigid members being separated to a second position corresponding to the first and second rigid members being in direct contact.

In another aspect, an electrical connector to connect circuit cards includes a compliant member that includes a first end portion and a second end portion, a spring assembly extending along an axis and configured to translate along the axis; the spring assembly forming a cavity extending along the axis and a pin configured to pass through the cavity and to engage the first end portion and the second end portion. The compliant member is configured to translate along the axis from a first position to a second position.

In a further aspect, a system includes a line replaceable unit that includes panels configured to provide radio frequency signals and disposed an exterior surface of the line replaceable unit and electrical circuitry disposed in an interior of the line replaceable unit. The circuitry includes a first circuit card, a second circuit card and an electrical connector electrically connecting the first circuit card to the second circuit card. The electrical connector includes a compliant member that includes a first end portion and a second end portion, a first rigid member attached to the first end portion of the compliant member and including a first bore extending along an axis, a second rigid member attached to the second end portion of the compliant member and including a second bore extending along the axis and a pin secured in the first bore and configured to move within the second bore. The compliant member is configured to translate along the axis from a first position corresponding to the first and second rigid members being separated to a second position corresponding to the first and second rigid members being in direct contact.

In a still further aspect, an electrical connector to connect circuit cards includes a compliant member including a first end portion and a second end portion and further including an electrically conductive layer, a first insulator layer disposed on a first surface of the electrically conductive layer and a second insulator layer disposed on a second surface of the electrically conductive layer opposite the first surface of the electrically conductive layer. The connector further includes a first rigid member attached to the first end portion of the compliant member and comprising a first bore extending along an axis, a second rigid member attached to the second end portion of the compliant member and comprising a second bore extending along the axis; and a pin secured in the first bore and configured to move within the second bore. The compliant member is configured to translate along the axis from a first position corresponding to the first and second rigid members being separated to a second position corresponding to the first and second rigid members being in direct contact. The compliant member further includes a first aperture aligned with the first bore and a second aperture aligned with the second bore. The first bore is configured to receive a first fastener through the first aperture to secure the connector to a first circuit card. The second bore is configured to receive a second fastener through the second aperture to secure the connector to a second circuit card.

In another aspect, a method to connect circuit cards includes providing an electrical connector. The electrical connector includes a compliant member that includes a first end portion and a second end portion, an electrically conductive layer, a first insulator layer disposed on a first surface of the electrically conductive layer and a second insulator layer disposed on a second surface of the electrically conductive layer opposite the first surface of the electrically conductive layer. The electrical connector also includes a first rigid member attached to the first end portion of the compliant member and comprising a first bore extending along an axis, a second rigid member attached to the second end portion of the compliant member and comprising a second bore extending along the axis and a pin secured in the first bore and configured to move within the second bore. The method also includes using a first fastener to connect the compliant member of the electrical connector to a first circuit card and using a second fastener to connect the electrical connector to a second circuit card spaced apart from the first circuit card. The compliant member is configured to translate along the axis from a first position corresponding to the first and second rigid members being separated to a second position corresponding to the first and second rigid members being in direct contact.

DETAILED DESCRIPTION

Sometimes it is desirable to transfer signals (e.g., power signals, digital signals and so forth) from one circuit board to another circuit board, where the circuit cards are stacked, for example. The circuit cards may be stacked in a parallel or substantially parallel configuration to one another. In situations, where cabling cannot be used due to mechanical packaging, electrical, cable length or other restrictions, other methods are required. In other situations, the connections between two circuit cards may be required to meet certain tolerance requirements.

As described herein, various examples of electrical connectors may be used to mate two circuit cards, for example, two circuit cards that are stacked together. As described herein, the term "stacked" means that the two circuit cards are spaced apart. As will be shown, when the two circuit cards are electrically connected, an electrical connector is disposed between the two circuit cards (e.g., an electrical connector 50 in FIG. 8C is disposed between circuit cards 102, 104). In one particular example, the two circuit cards are parallel or substantially parallel. While the embodiments of the electrical connector described herein are used in an antenna panel array radio frequency (RF) system environment, the electrical connector may be used in any environment that electrically connects circuit cards together.

Figure 1:
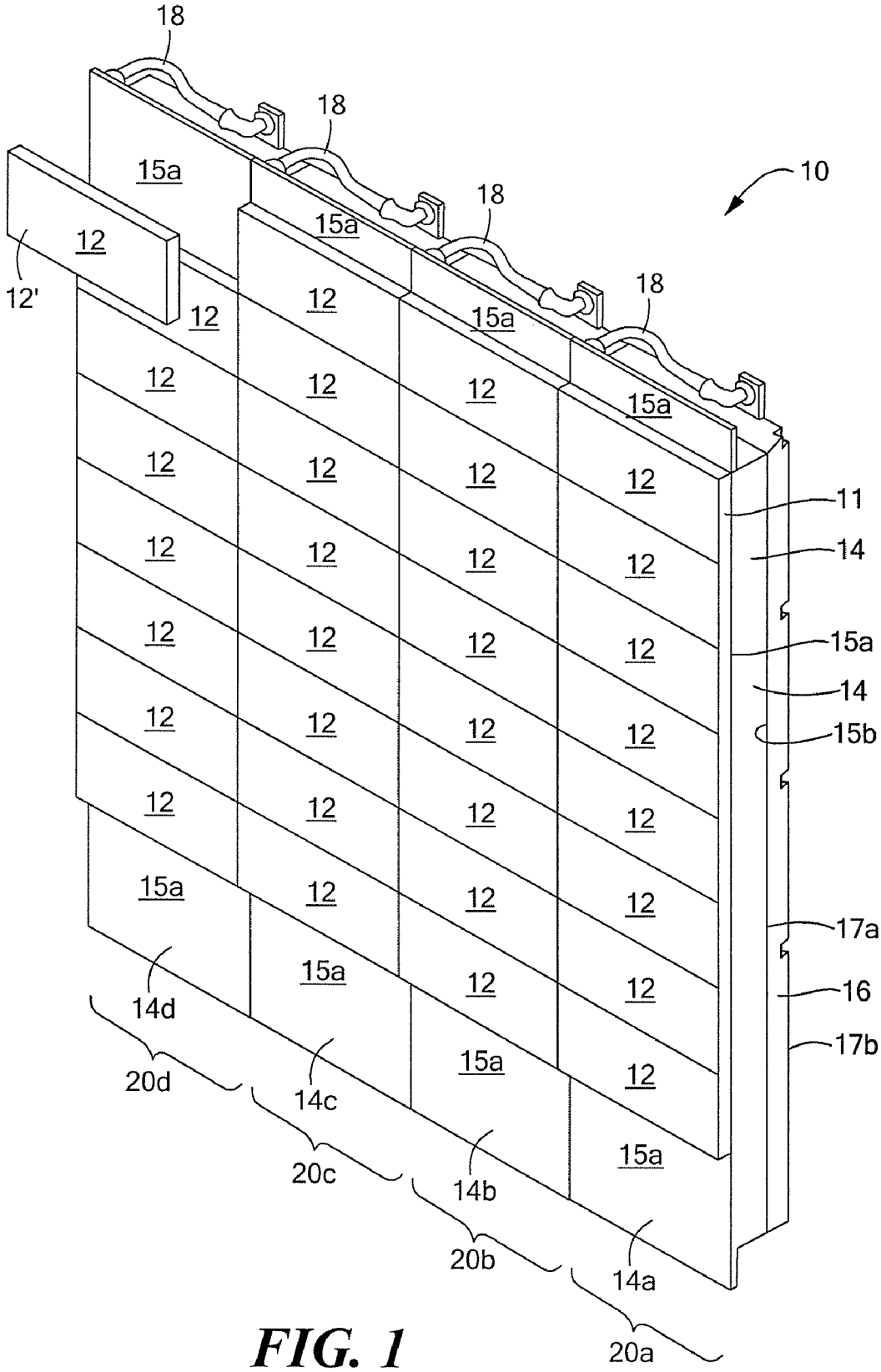
FIGS. 1 to 3 are a series of isometric views showing front, back and side views of a radio frequency (RF) transmit/receive system.
Figure 2:
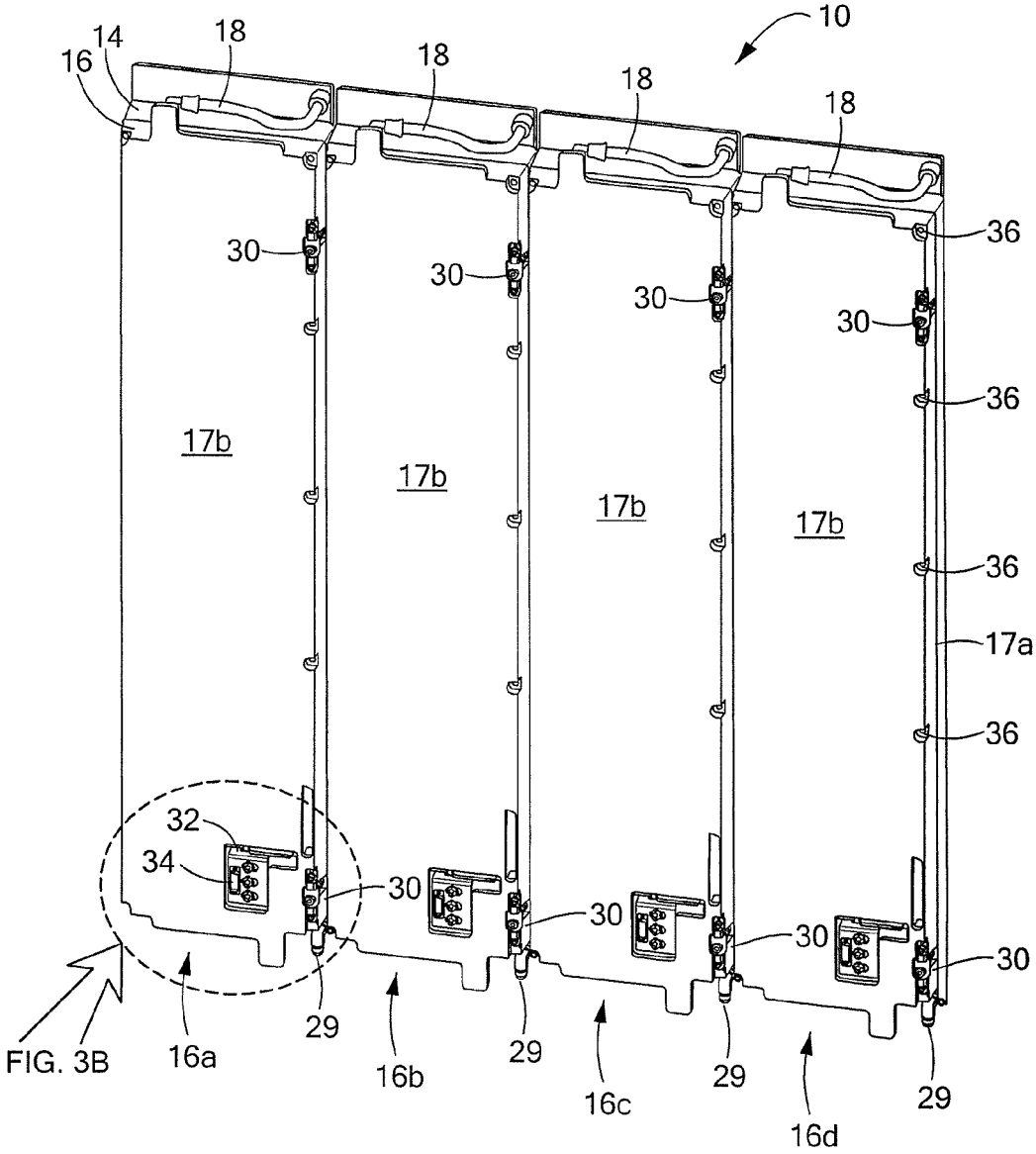
Figure 3:
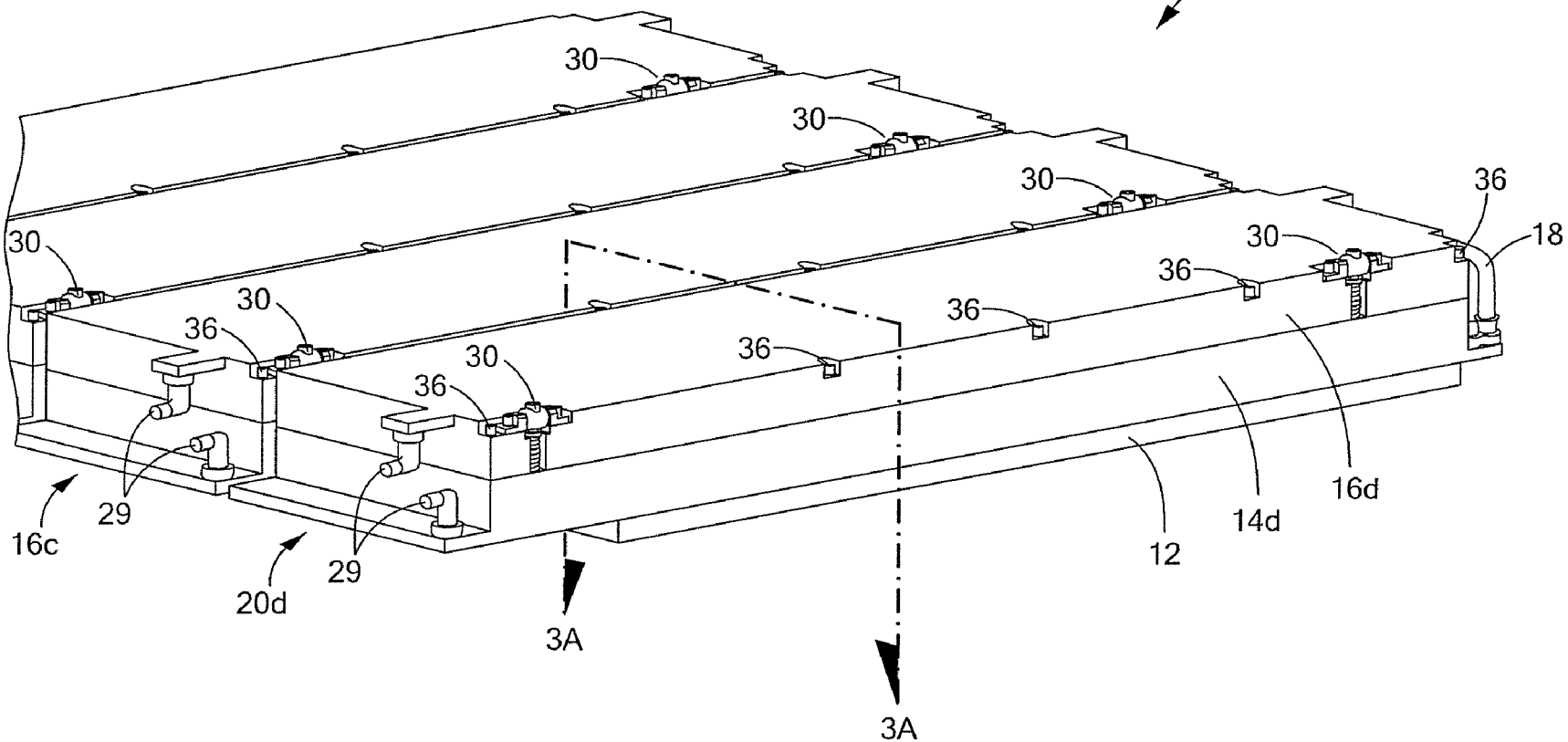

Referring now to FIGS. 1 to 3, in which like elements are provided having like reference designations throughout the several views, an antenna panel array subsystem 10 is a portion of a radar, communications or other RF transmit/receive system. The antenna panel array subsystem 10 includes an array antenna 11 provided from a plurality (or an array) of so-called RF "antenna panels" 12 (sometimes more simply referred to herein as "panel 12"). The array antenna 11 has a so-called "panel architecture." The panels 12 are removably attached to LRUs 20. For example, a panel 12' is shown detached (e.g., in an exploded view) from the LRUs 20.

In one example, the panels 12 are stand-alone units. That is, the panels 12 are each independently functional units (i.e., the functionality of one panel does not depend on any other panel). For example, the feed circuit for each panel 12 is wholly contained within the panel itself and is not coupled directly to any other panel. In the event that one panel 12 fails, the panel 12 may simply be removed from the array 11 and another panel can be inserted in its place. This characteristic is particularly advantageous in RF transmit/receive systems deployed in sites or locations where it is difficult to service the RF system in the event of some failure.

In one example, the antenna panel array subsystem 10 is a phased array RF system. The relatively high cost of phased arrays has precluded the use of phased arrays in all but the most specialized applications. Assembly and component costs, particularly for active transmit/receive channels, are major cost drivers. Phased array costs can be reduced by utilizing batch processing and minimizing touch labor of components and assemblies. Therefore, it is advantageous to provide a tile sub-array (e.g., the panel 12), for an Active, Electronically Scanned Array (AESA) that is compact, which can be manufactured in a cost-effective manner, that can be assembled using an automated process, and that can be individually tested prior to assembly into the AESA. By using a tile sub-array (e.g., a panel) configuration, acquisition and life cycle costs of phased arrays are lowered, while at the same time improving bandwidth, polarization diversity and robust RF performance characteristics to meet increasingly more challenging antenna performance requirements.

In one example, the panel array subsystem 10 enables a cost-effective phased array solution for a wide variety of phased array radar missions or communication missions for ground, sea and airborne platforms. In at least one example, the panel array system 10 provides a thin, lightweight construction that can also be applied to conformal arrays attached to an aircraft wing or a fuselage or a sea vessel or a Unmanned Aerial Vehicle (UAV) or a land vehicle.

Other panels, phased arrays and phased array configurations may be found in U.S. Pat. No. 7,348,932 and U.S. Pat. No. 6,624,787, which are incorporated herein in their entirety and are assigned to the same assignee (Raytheon Company of Waltham, Mass.) as the present patent application.

The panel 12 maintains a low profile, for example, by stacking a plurality of multilayer circuit boards that provide one or more circuit assemblies in which RF and other electronic components are disposed in close proximity with each other. The operation of such electronic components uses electrical power and dissipates energy in the form of heat so that the panels 12 are cooled to reduce the heat. For example, as shown in FIGS. 1 to 3, array antenna 11 (and more specifically the panels 12) is coupled to a panel heat sink 14. In this example, the panel heat sink 14 includes, for example, four separate sections 14*a*-14*d*. A first surface of each heat sink section 14*a*-14*d* is designated 15*a* and a second opposing surface of each heat sink section 14*a*-14*d* is designated 15*b* so that RF panels 12 are coupled to the first surface 15*a* of heat sink 14.

A rear heat sink 16 is coupled to surface 15*b* of heat sink 14. In this example, the rear heat sink 16 includes, for example, four separate sections 16*a*-16*d* (FIG. 2). A first surface of each heat sink section 16*a*-16*d* is designated 17*a* and a second opposing surface of each heat sink section 16*a*-16*d* is designated 17*b* so that portions of the heat sink surface 15*b* contact portions of heat sink surface 17*a*.

A set or combination of heat sink sections and associated panels can be removed from the array 11 and replaced with another set of heat sink sections and associated panels. Such a combination is referred to as a line replaceable unit (LRU). For example, heat sink sections 14*a*, 16*a* and the panels dispose on heat sink section 14*a* form a LRU 20*a*. In one particular example, the panel array system 10 includes four LRUs 20*a*-20*d* with each of the LRUs including eight panels 12, a corresponding one of the panel heat sink sections 14*a*-14*d* and a corresponding one of the rear heat sink sections 16*a*-16*d*.

Figure 3A:
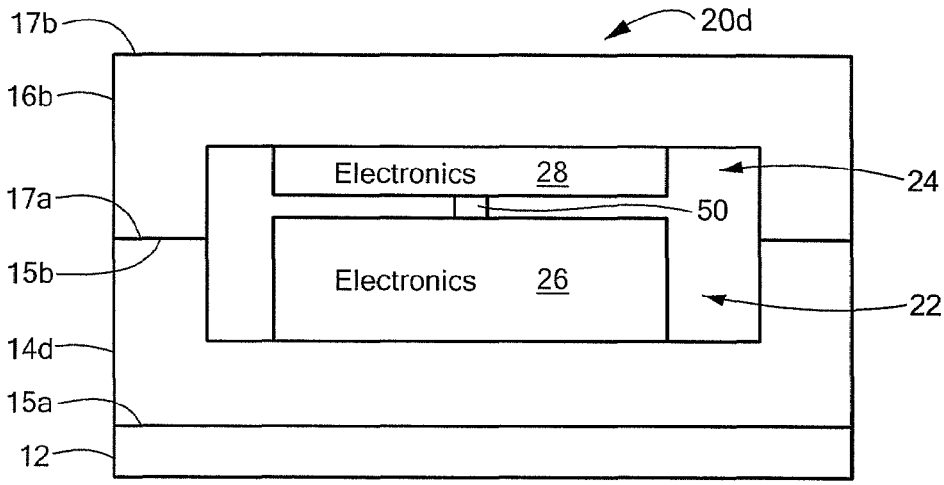
FIG. 3A is a cross-sectional view of an LRU shown in FIG. 3 and taken across lines 3A-3A in FIG. 3.

Referring briefly to FIG. 3A, taking the LRU 20*d* as representative of the LRUs 20*a*-20*c*, each of the heat sinks 14*d*, 16*d* are provided having respective recess regions 22, 24 in which electronics 26, 28 are disposed. When the heats sinks 14, 16 are coupled together, the electronics 26, 28 are effectively disposed in a cavity region formed by the recesses 22, 24 and associated internal surfaces of the respective heat sinks 14, 16. In one example, the panel heat sink 14 primarily cools the panels 12 and the electronics 26 while the rear heat sink 16 primarily cools the electronics 28. In one example, the electronics 26 and the electronics 24 each include circuit cards 102, 104 (FIG. 7) connected by an electrical connector 50. The connector 50 supplies signals (e.g., power signals) between the circuit cards 102, 104.

Other heat sink configurations are known to one of ordinary skill in the art. For example, only one of the heat sinks 14, 16 may be provided having a recess region with electronics disposed therein. Alternatively, in some examples, neither of the heat sinks 14, 16 may be provided having a recess region. The particular manner in which to provide the heat sinks and in which to couple the electronics depends upon the particular application and the factors associated with the application.

In one example, the heat sinks 14, 16 are provided as so-called cold plates which use a liquid, for example, to cool any heat generating structures (such as the panels 12 and the electronics 26, 28) coupled thereto. For example, the liquid is fed through channels (not shown) provided in the heat sinks 14, 16 via fluid fittings 29 and fluid paths 18. In one example, each of the heat sinks 14, 16 may include different components or subassemblies coupled together (as shown in FIGS. 1 to 3) or alternatively heat sinks 14, 16 may be provided as monolithic structures.

Since the electronics are disposed between a surface of the panel heat sink and an internal surface of the rear heat sink, the electronics 26, 28 are not accessible when the panel heat sink 14 and rear heat sink 16 are coupled as shown in FIGS. 1 to 3. In order to provide access to the recess region of the rear heat sink 16 (and thereby provide access to the electronics disposed in the recess region of rear heat sink 16), one or more translating hinges 30 couples panel heat sinks 14*a*-14*d* to respective ones of rear heat sinks 16*a*-16*d*.

As may be more clearly seen with reference to FIGS. 2 to 4 heat sinks 14*a*-14*d* are coupled to heat sinks 16*a*-16*d* respectfully via fasteners 36 and translating hinges 30. In one example, the fasteners 36 are provided as screws which are captive in heat sink 16 and which mate with threaded holes provided in the heat sink 14. It should be appreciated that one of ordinary skill in the art would understand how to select an appropriate type and number of fasteners 36 to use in any particular application.

Figure 3B:
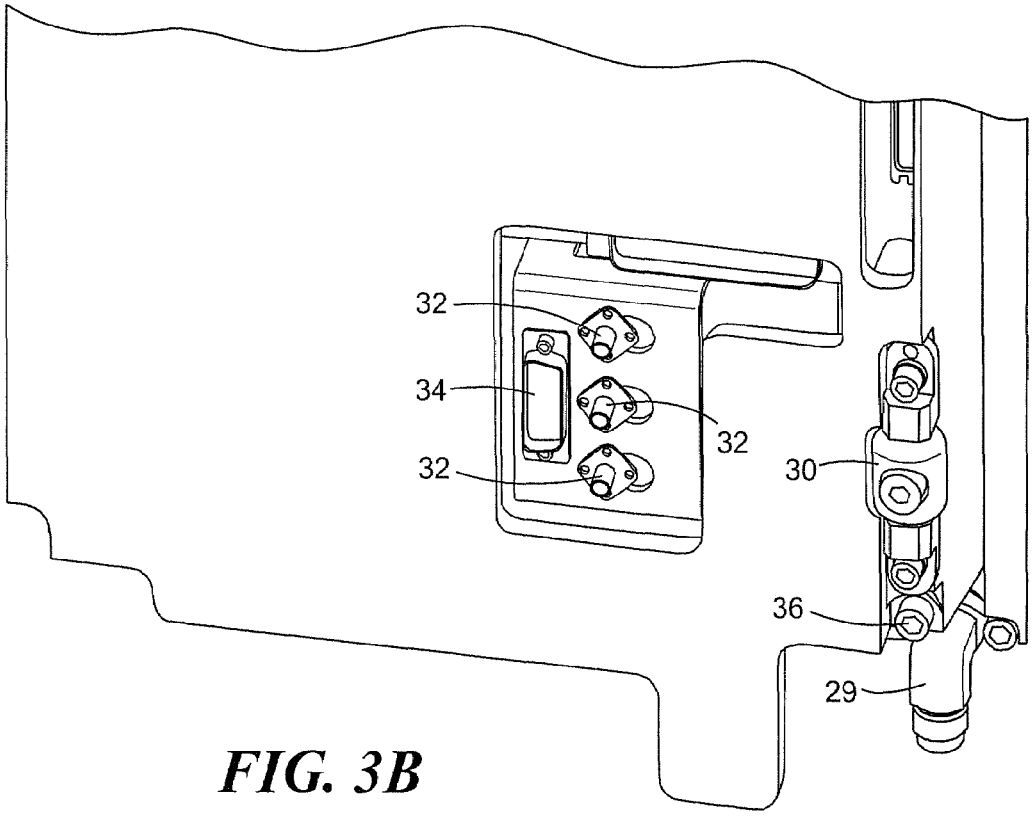
FIG. 3B an enlarged top view of a hinge on the radio frequency (RF) transmit/receive system taken across lines 3B-3B in FIG. 2.
Figure 4A:
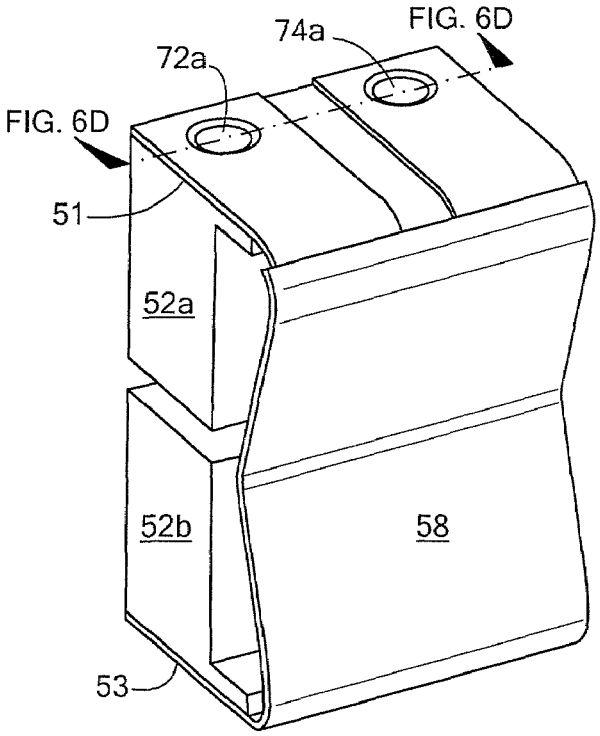
FIGS. 4A to 4C are views of an example of an electrical connector.
Figure 4B:
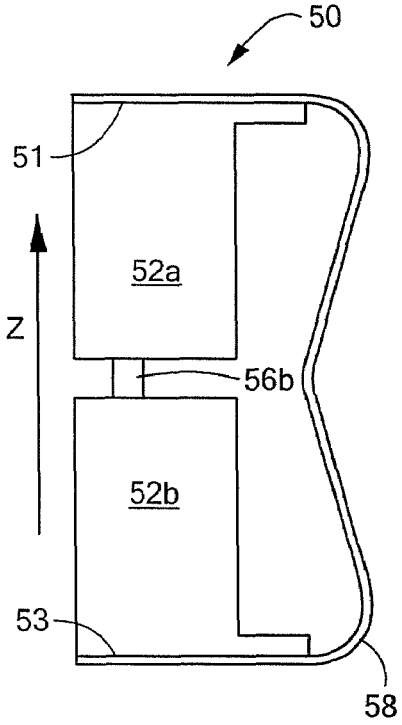
Figure 4C:
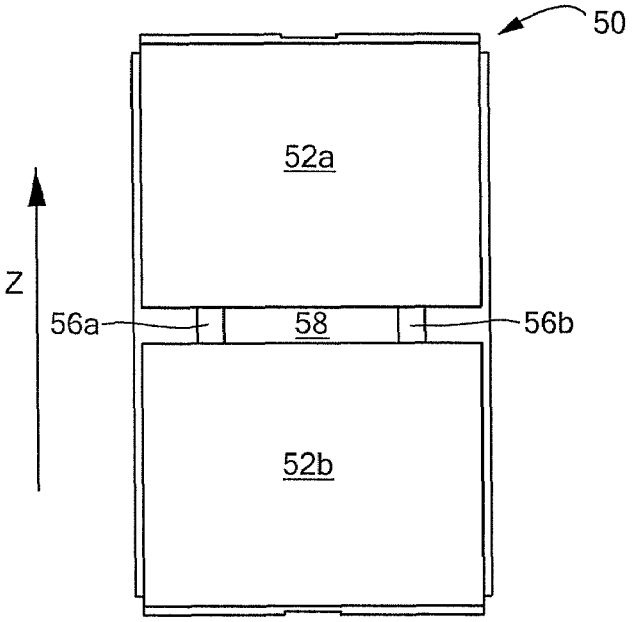
Figure 4D:
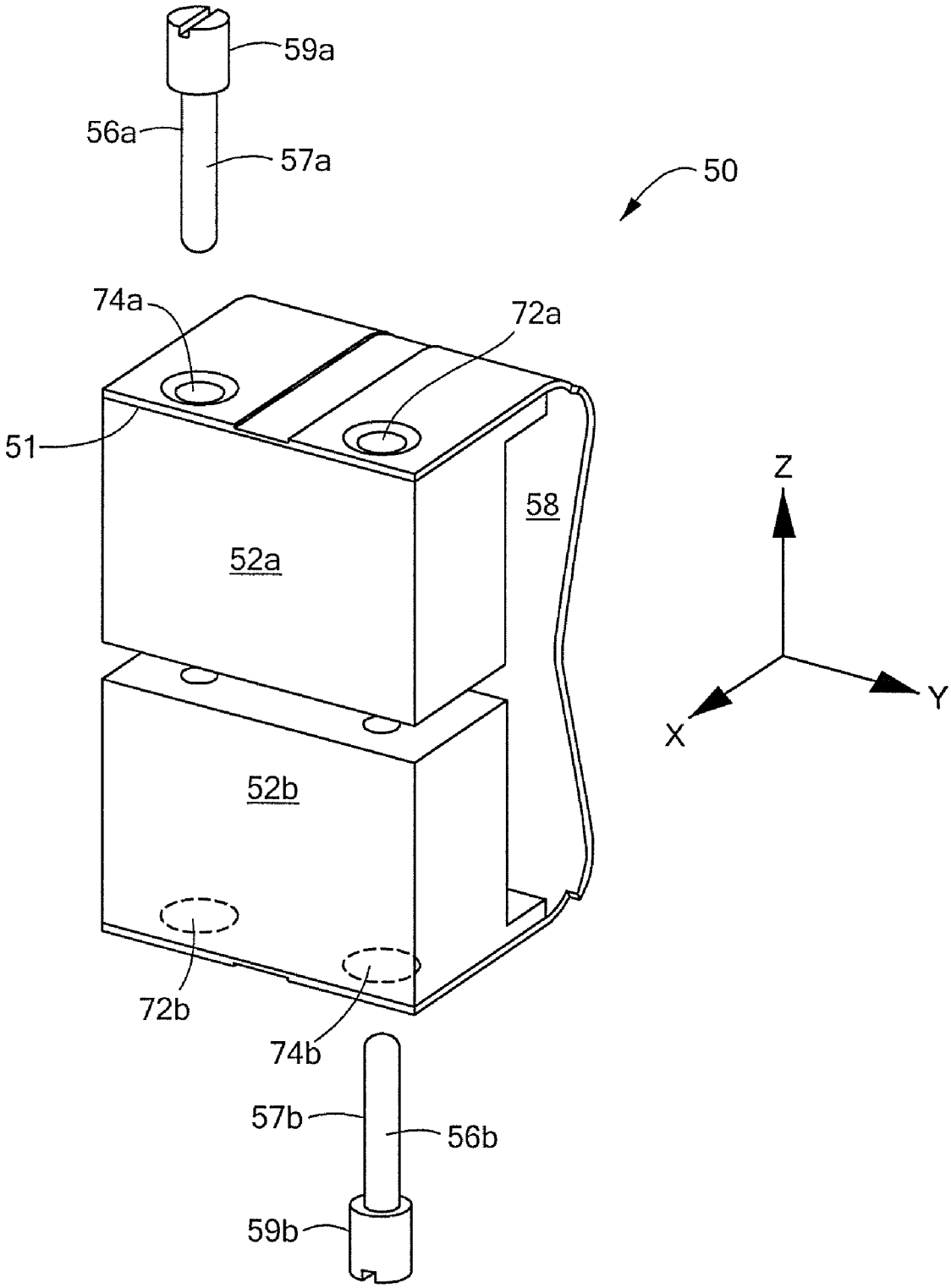
FIG. 4D is a view of the electrical connector in FIGS. 4A to 4C with the alignment screws exploded.

As seen in FIGS. 3 and 3B, translating hinge 30 couples panel heat sink 14*d* to rear heat sink 16*d*. Hinging panel heat sink 14*d* and rear heat sink 16*d* is beneficial since when servicing either of the assemblies, hinges 30 captivate the heat sinks 14*d*, 16*d* and thus neither heat sink 14*d*, 16*d* is loose. This reduces the chance of damage to either of heat sinks 14*d*, 16*d*. Also, since neither heat sink is ever loose, the translating hinges 30 improve serviceability of the heat sinks 14, 16 as well as the serviceability of the electronics 26, 28 disposed in the recess regions of heat sinks 14*d*, 16*d*.

It should be appreciated that in FIGS. 2 and 3 each of panel heat sinks 14*a*-14*d* are coupled to respective rear heat sinks 16*a*-16*d* by a pair of translating hinges 30, in other embodiments fewer or more than two translating hinges may be used.

The translating hinge approach eliminates the need for a coolant quick disconnect that would be required to separate the two cold plates. Fewer quick disconnects mean fewer leaks and a more robust, reliable system. Furthermore, electrical interconnections to (e.g., from external locations as through RF and DC/logic connectors 32, 34 in FIG. 3B) and/or between electronics 26, 28 can remain intact during servicing. This reduces the possibility of damage to connectors (e.g., due to disconnecting and reconnecting electrical connectors) and also allows access to and testing of the electronics in an easily accessible configuration.

Figure 7:
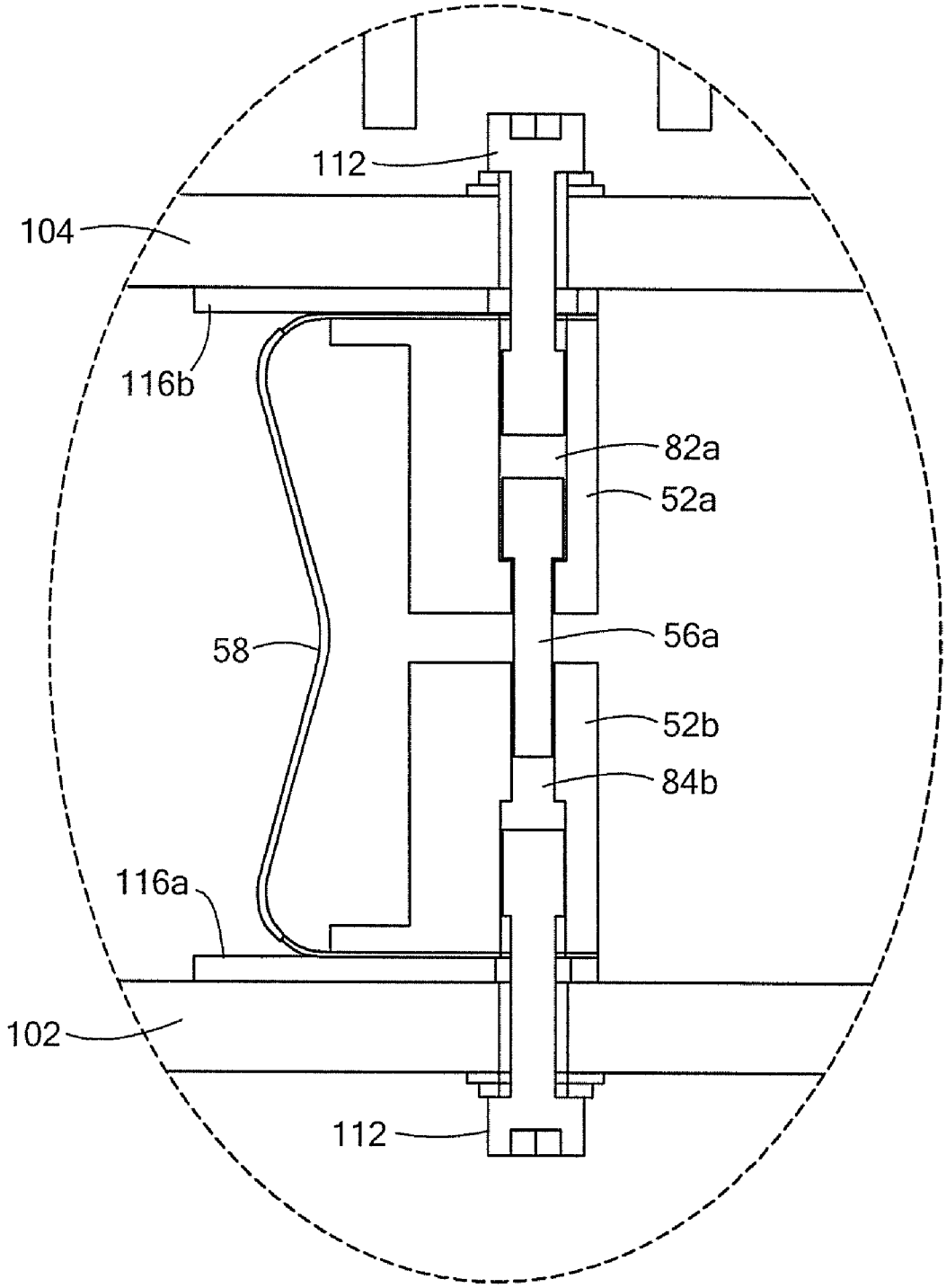
FIG. 7 is a cross-sectional view of the electrical connector of FIGS. 4A to 4D connecting two circuit cards.

Referring to FIGS. 4A to 4D, an electrical connector 50 is used to transfer signals (e.g., power signals, digital signals and so forth) between the first and second circuit cards 102, 104 (FIG. 7). In one example, the electrical connector 50 is used as a low-inductance connector. The electrical connector 50 includes rigid members 52*a*, 52*b*, alignment pins 56*a*, 56*b* and a compliant member 58. The rigid member 52*a* is attached to one end portion 51 of the compliant member 58 and the rigid member 52*b* is attached to the other end portion 53 of the compliant member 58. In one example, the rigid members 52*a*, 52*b* are attached to the compliant member 58 using an epoxy or an adhesive.

The connector 50 includes four apertures on the compliant member 58. A first set of apertures 72*a*, 74*a* on the one end 51 of the compliant member 58 and a second set of apertures 72*b*, 74*a* on the other end 53 of the compliant member 58

The alignment pins 56*a*, 56*b* each include a body portion and a threaded head portion (e.g., the alignment pin 56*a* includes a body portion 57*a* and a head portion 59*a* and the alignment pin 56*b* includes a body portion 57*b* and a head portion 59*b*). The alignment pins 56*a*, 56*b* are secured within a corresponding one of the rigid member 52*a*, 52*b* and the body portions 57*a*, 57*b* extend along a Z-axis into the other of the rigid member 52*b*, 52*a*. As will be shown further, the compliant member 58 flexes along the Z-axis and conducts electricity between its end portions 51, 53 which allows electrical signals to pass between, for example, the first and second circuit cards 102, 104 (FIG. 7).

Referring to FIGS. 5A to 5D, the compliant member 58 includes a first insulator layer 62*a*, a first electrically conductive layer 64*a*, a second insulator layer 62*b*, a second electrically conductive layer 64*b* and a third insulator layer 62*c*. The first electrically conductive layer 64*a* includes apertures 74*a*", 72*b*", the second electrically conductive layer 64*b* includes apertures 72*a*", 74*b*", and the third insulator layer 62*c* includes apertures 72*a*', 74*a*', 72*b*', 74*b*'. When the layers 62*a*-62*c*, 64*a*, 64*b* are combined the apertures 72*a*', 72*a*" form the aperture 72*a*, the apertures 72*b*', 72*b*" form the aperture 72*b*, the apertures 74*a*', 74*a*" form the aperture 74*a* and the apertures 74*b*', 74*b*" form the aperture 74*b*.

Figure 5A:
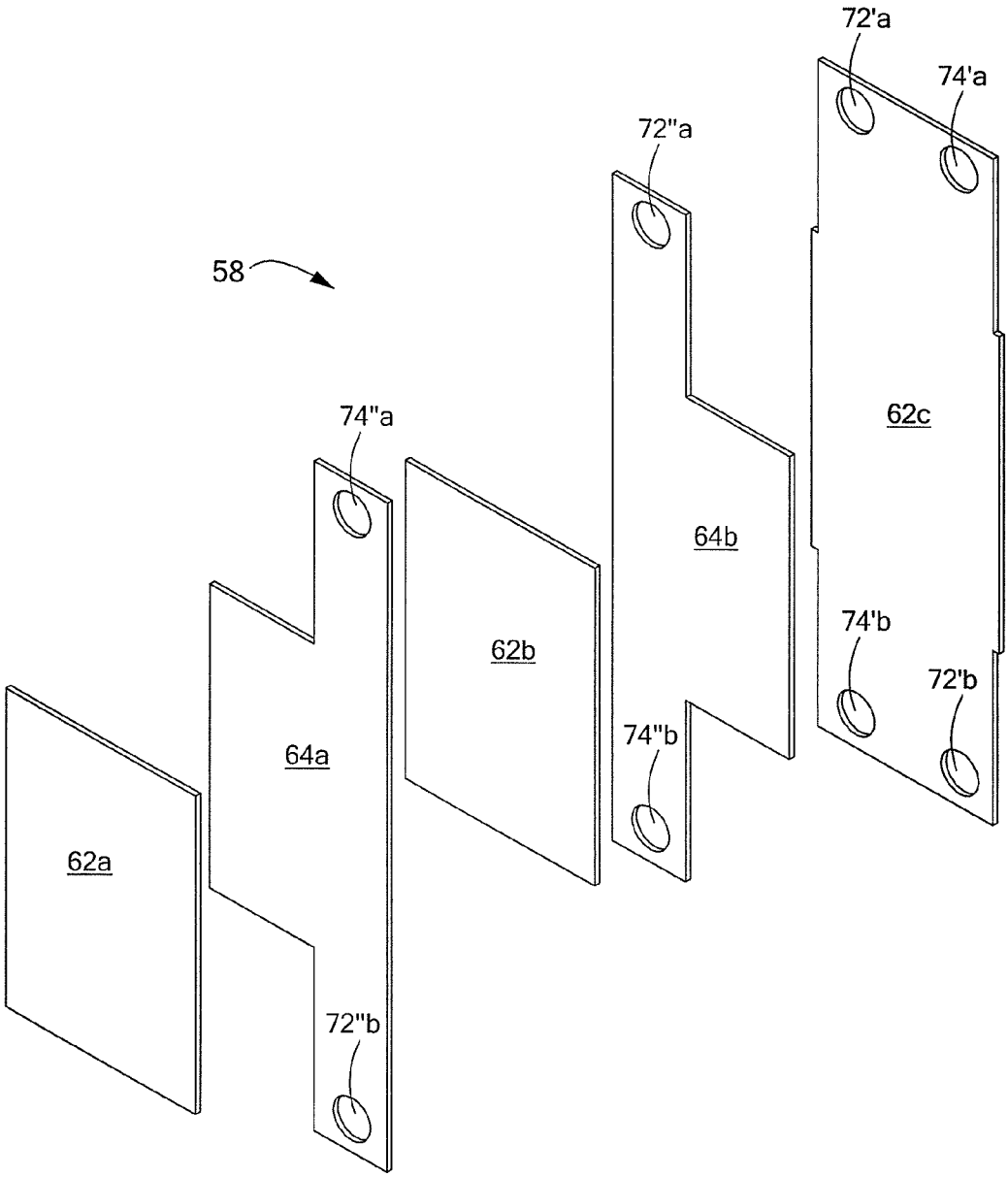
FIG. 5A is an exploded view of a compliant element.
Figure 5B:
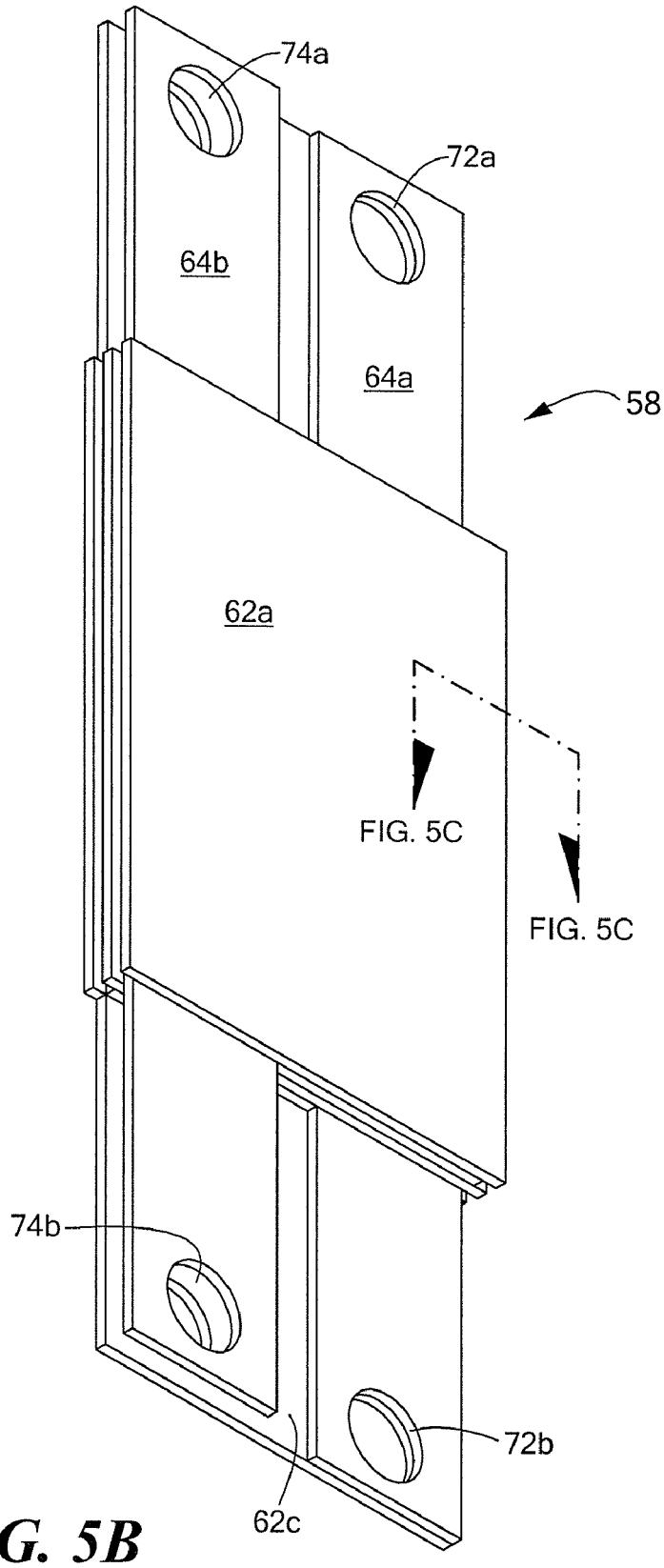
FIG. 5B is a view of the compliant element before being shaped.
Figure 5C:
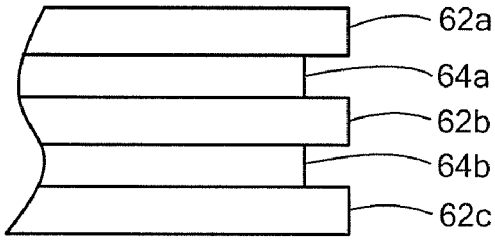
FIG. 5C is a cross-section of the compliant member of FIG. 5B taken along the lines 5C-5C.
Figure 5D:
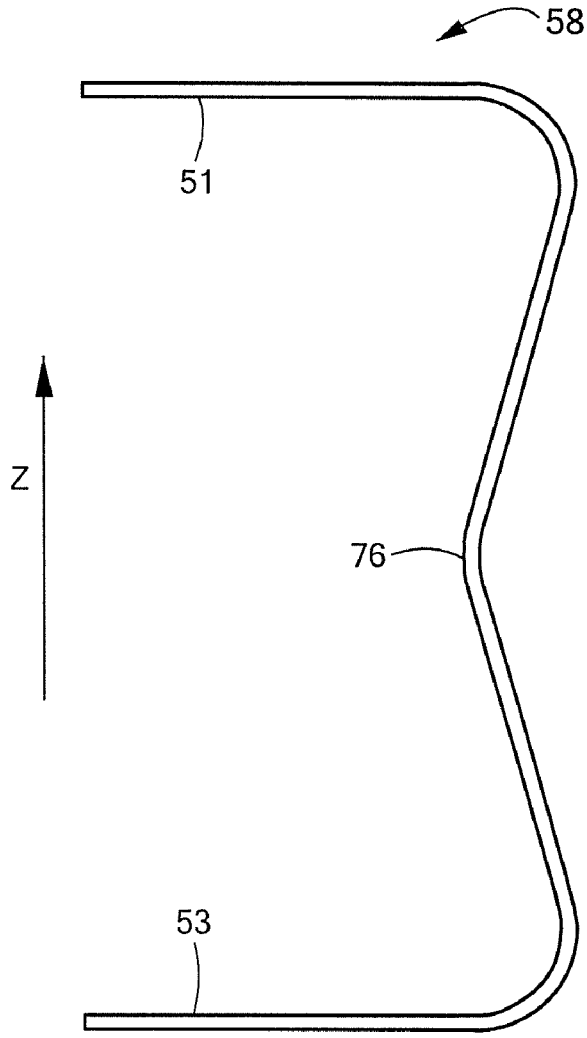
FIG. 5D is a view of the compliant element after being shaped.

In one example, the insulator layers 62*a*, 62*c* protect the electrically conductive layers 64*a*, 64*b* respectively from external damage such as nicks and scratches. The insulation layers 62*a*-62*c* also prevent an electrical short-circuit between the electrically conductive layers 64*a*, 64*b* by separating the electrically conductive layers to prevent the electrically conductive layers from touching (FIG. 5C). Generally, in fabricating the compliant member 58, the insulator layers 62*a*-62*c* and the electrically conductive layers 64*a*, 64*b* are flat initially and subsequently bent and shaped. For example, the compliant member 58 is shaped to include a flex point 76 so that the compliant member may flex in the Z-axis. In one example, the electrically conductive layers 64*a*, 64*b* are metal layers such as copper, aluminum and so forth. In one example, the insulator layers 62*a*-62*c* are polyimide laminate layers. In one example, the compliant member 58 allows for an inductance of the connector 50 to be about 0.5 nH.

The electrically conductive layers 64*a*, 64*b* may be resized to meet various system requirements (e.g., current requirements, inductance requirements). In some examples, shape, height, and amount of tolerance compensation of the compliant member 58 may be tailored to fit different applications.

Figure 6A:
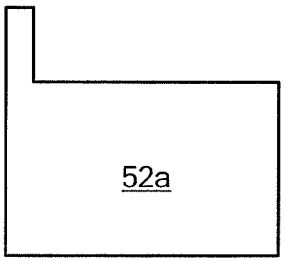
FIGS. 6A and 6B are views of a rigid member.
Figure 6B:
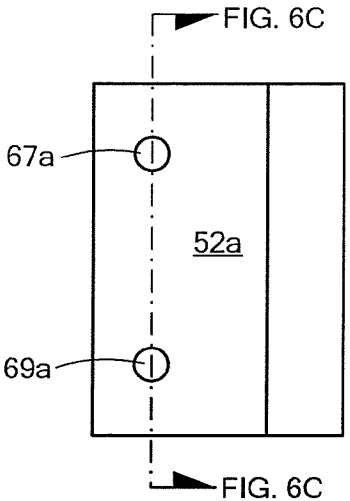
Figure 6C:
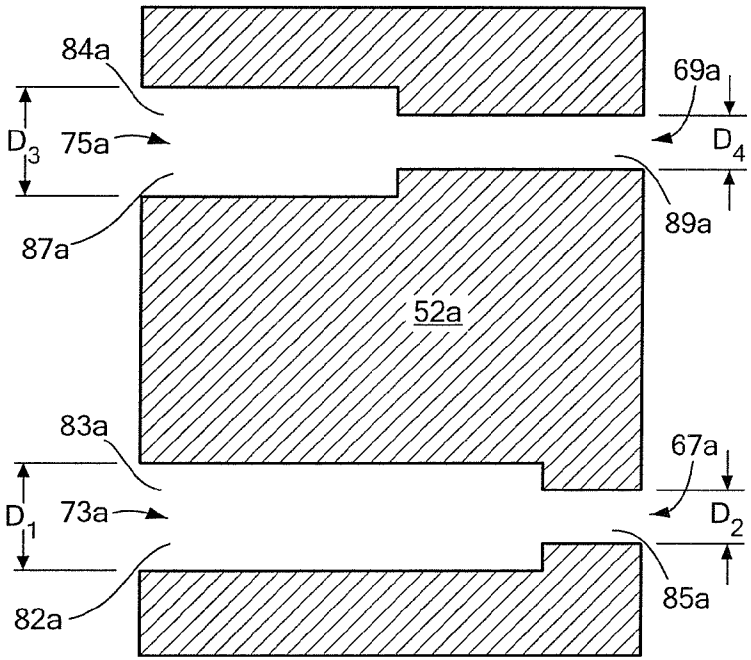
FIG. 6C is a cross-sectional view of the rigid member in FIG. 6B taken along the lines 6C-6C.

Referring to FIGS. 6A to 6C, the rigid members 52*a*, 52*b* are substantially the same so that the rigid member 52*b* may be represented by the rigid member 52*a* in FIGS. 6A to 6C. In one example, the rigid members 52*a*, 52*b* are an epoxy glass laminate such as FR-4 and G-10, for example.

The rigid member 52*a* includes bores 82*a*, 84*a* to receive the alignment pins 56*a*, 56*b*. For example, the bore 82*a* includes an aperture 73*a* for receiving the alignment pin 56*a* and the bore 84*a* includes an aperture 69*a* for receiving the alignment pin 56*b*. The aperture 73*a* is aligned with the aperture 74*a* of the compliant member 58.

The bore 82*a* included two portions 83*a*, 85*a*. The first portion 83*a* is threaded and has a first diameter, $D_1$, to engage the head portion 59*a* of the alignment pin 56*a*. The second portion 85*a* has a second diameter, $D_2$, that is smaller than the first diameter, $D_1$, but large enough for the body portion 57*a* of the alignment pin 56*a* to pass through. The bore 82*a* is sufficiently long enough to accommodate a fastener 112 (FIG. 7).

The bore 84*a* included two portions 87*a*, 89*a*. The first portion 87*a* is threaded and has a first diameter, $D_3$, to engage a fastener 112 (FIG. 7). The aperture 75*a* is aligned with the aperture 72*a* of the compliant member 58. The second portion 89*a* has a second diameter, $D_4$, that is smaller than the first diameter, $D_3$, but large enough for the body portion 57*b* of the alignment pin 56*b* to pass through the aperture 69*a*. The bore 87*a* is sufficiently long enough to accommodate a fastener 112 (FIG. 7).

In one example, the diameters $D_1$ and $D_3$ are equal. In another example, the diameters $D_2$ and $D_3$ are equal.

Figure 6E:
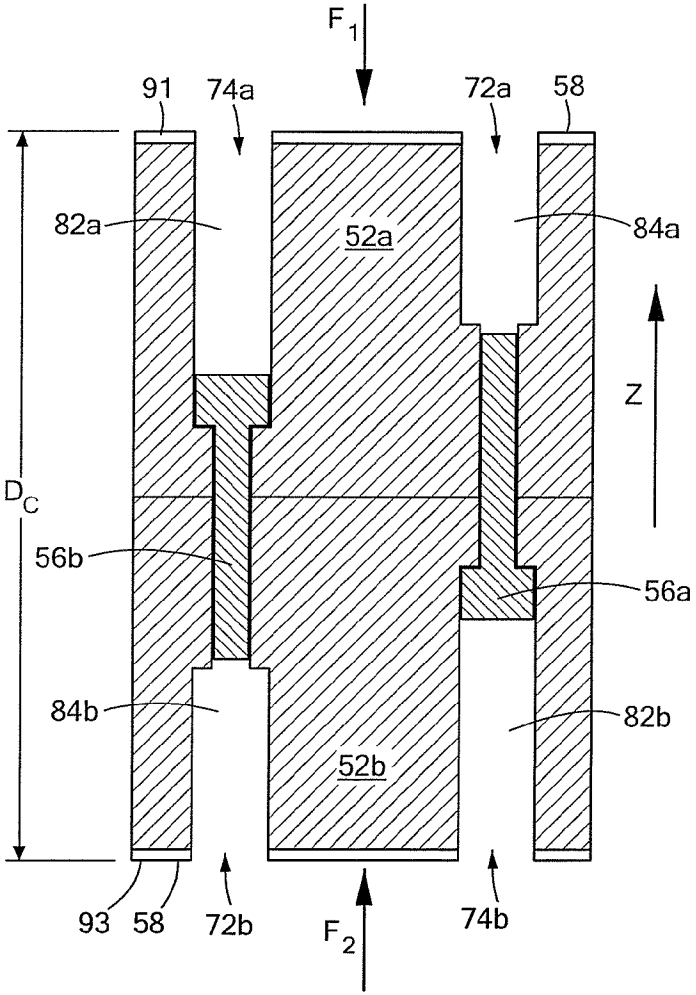
FIG. 6E is another cross-sectional view of the electrical connector of FIG. 6D with the connector flexed.
Figure 6D:
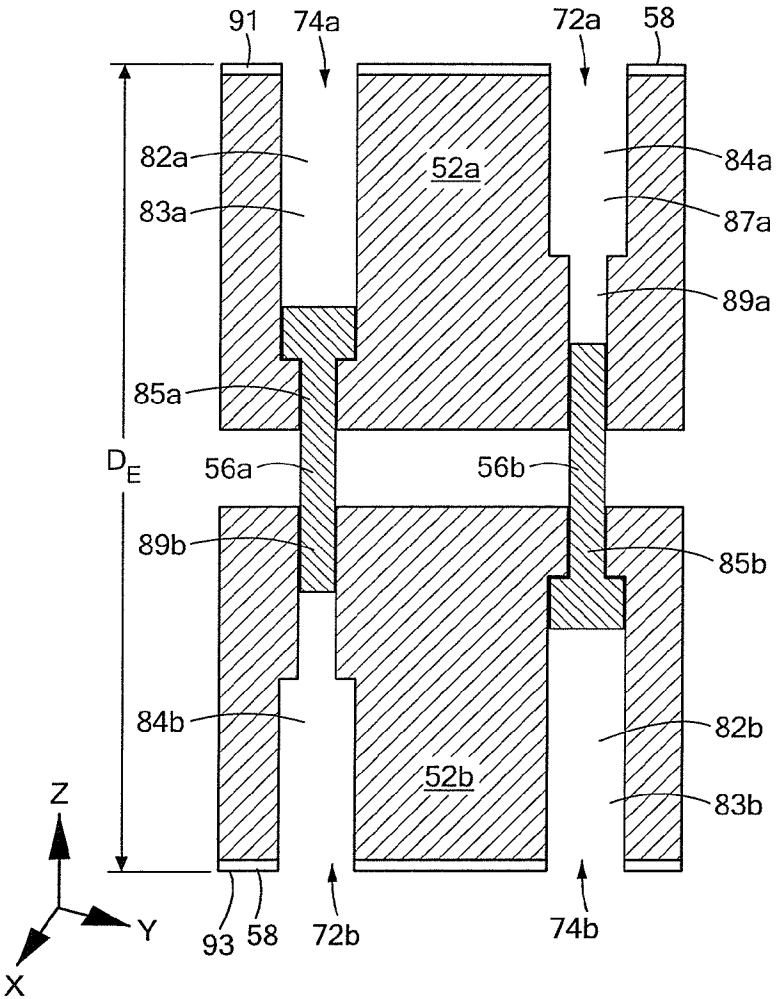
FIG. 6D is a cross-sectional view of the electrical connector in FIG. 4A taken long along the line 6D-6D.

Referring to FIGS. 6D and 6E, in one example, the alignment pin 56*a* is installed into the connector 50 by passing the alignment pin 56*a* through the aperture 74*a* into the bore 82*a* and is screwed into the first portion 83*a* of the bore 82*a* so that the head portion 59*a* of the alignment pin 56*a* is secured in the first portion 83*a* of the bore 82*a*. The body portion 57*a* of the alignment pin 56*a* extends through the second portion 85*a* of the bore 82*a* into a second portion 89*b* of the bore 84*b* of the rigid member 52*b*.

The alignment pin 56*b* is installed into the connector 50 by passing the alignment pin 56*b* through the aperture 74*b* into the bore 82*b* and screwed into the first portion 83*b* of the bore 82*b* so that the head portion 59*b* of the alignment pin 56*b* is secured in the first portion 83*b* of the bore 82*b*. The body portion 57*b* of the alignment pin 56*b* extends through the second portion 85*b* of the bore 82*b* into a second portion 89*a* of the bore 84*a* of the rigid member 52*a*.

Without any force being applied to the electrical connector 50, a distance from a top surface 91 of the electrical connector to a bottom surface 93 of the electrical connector is an extension distance, $D_E$. When a force $F_1$ is applied to one end of the connector 50 and an equal force $F_2$ is applied to the opposite end of the connector, the compliant member 58 bends at the flex point 76 until the rigid members 52*a*, 52*b* are in contact so that the rigid members 52*a*, 52*b* function as mechanical stops (FIG. 6E). A distance from a top surface 91 of the electrical connector to a bottom surface 93 of the electrical connector shrinks to a compression distance, $D_C$. The ability of the electrical connector 50 to flex in the Z direction accounts for tolerances which arise due to fabrication and assembly variations. For example, the Z-axis compensation by the electrical connector 50 absorbs inherent tolerances that exist between two circuit cards 102, 104 that are mounted to unique surfaces. In particular, a thickness tolerance, $D_{TOL1}$, (FIG. 8B) of the first circuit card 102 and a thickness tolerance, $D_{TOL2}$, (FIG. 8B) of the second card 104 are added together to determine the amount of the extension distance, $D_E$ and the compression distance, $D_C$ that are required by the electrical connector 50. In one example, the electrical connector 50 accounts for differences in circuit card thickness of +/−10%. Other tolerances may rise from machining of the heat sink sections 14, 16, for example, a tolerance distance $D_{TOL3}$, (FIG. 8B) for the heat sink section 14 and a tolerance distance for the heat sink section 16 $D_{TOL4}$ (FIG. 8B).

Referring to FIG. 7, in one example, the electrical connector 50 is used to connect a first circuit card 102 and a second circuit card 104. The electrical connector 50 is secured to the first circuit card 102 by fasteners 112. The fasteners 112 extend through the first circuit card 102 through a contact pad 116*a* (e.g., a metal contact pad), through apertures 74*a*, 72*a* into a corresponding bore 82*a*, 84*a*. The electrical connector 50 is also secured to the second circuit card 104 by the fasteners 112. The fasteners 112 extend through the second circuit card 104 through a contact pad 116*b* (e.g., a metal contact pad), through apertures 74*b*, 72*b* into a corresponding bore 82*b*, 84*b*. The fasteners complete an electrical connection between the first circuit card 102 and the second circuit card 104 so that the signals between the circuit cards passes through the compliant member 58. In one example, the fasteners 112 are screws (e.g., threaded screws) that engage the threads in the bores 82*a*, 82*b*, 84*a*, 84*b*.

Figure 8A:
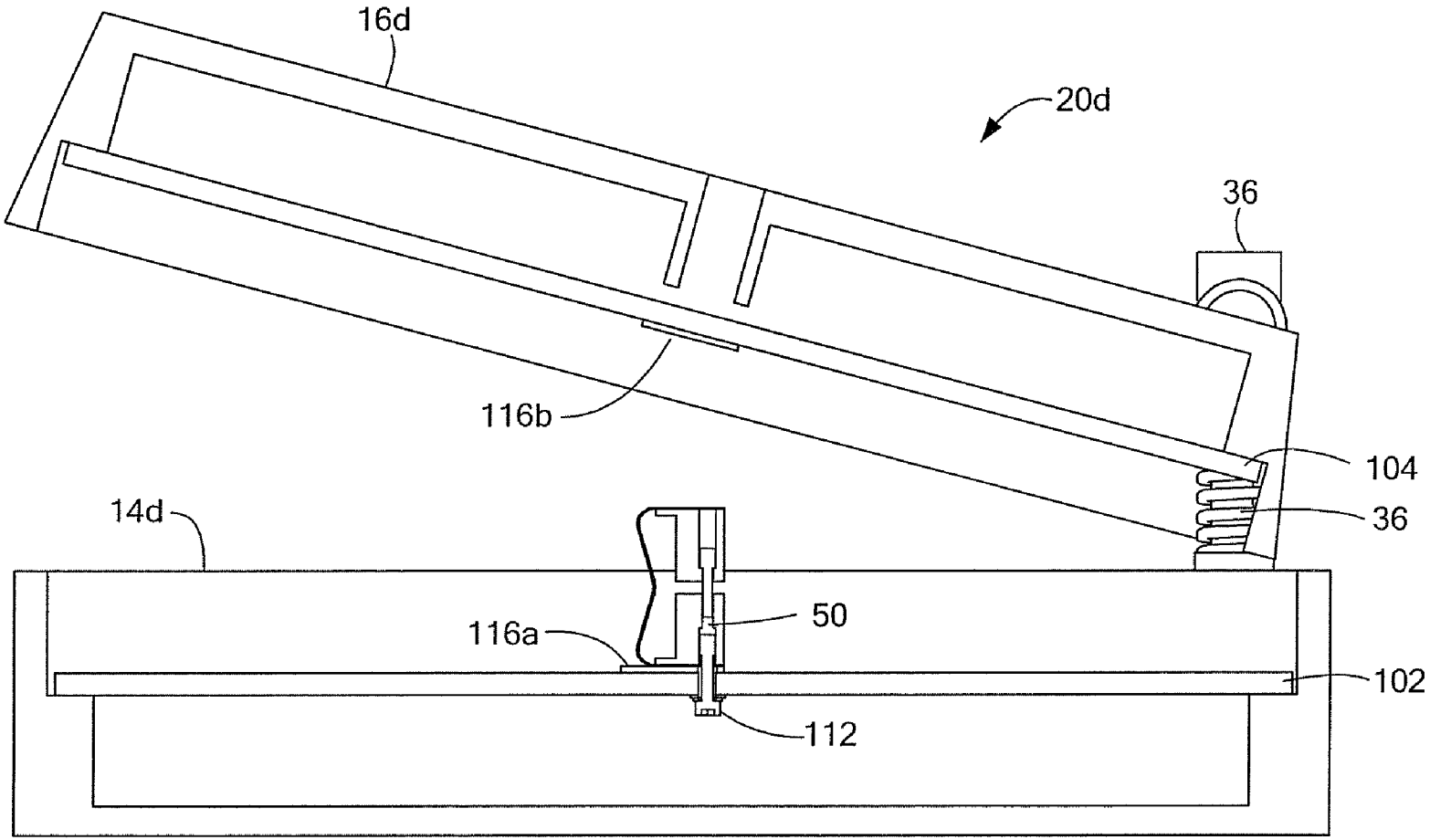
FIGS. 8A to 8C are views of connecting a first circuit card to a second circuit card in a panel array subsystem.
Figure 8B:
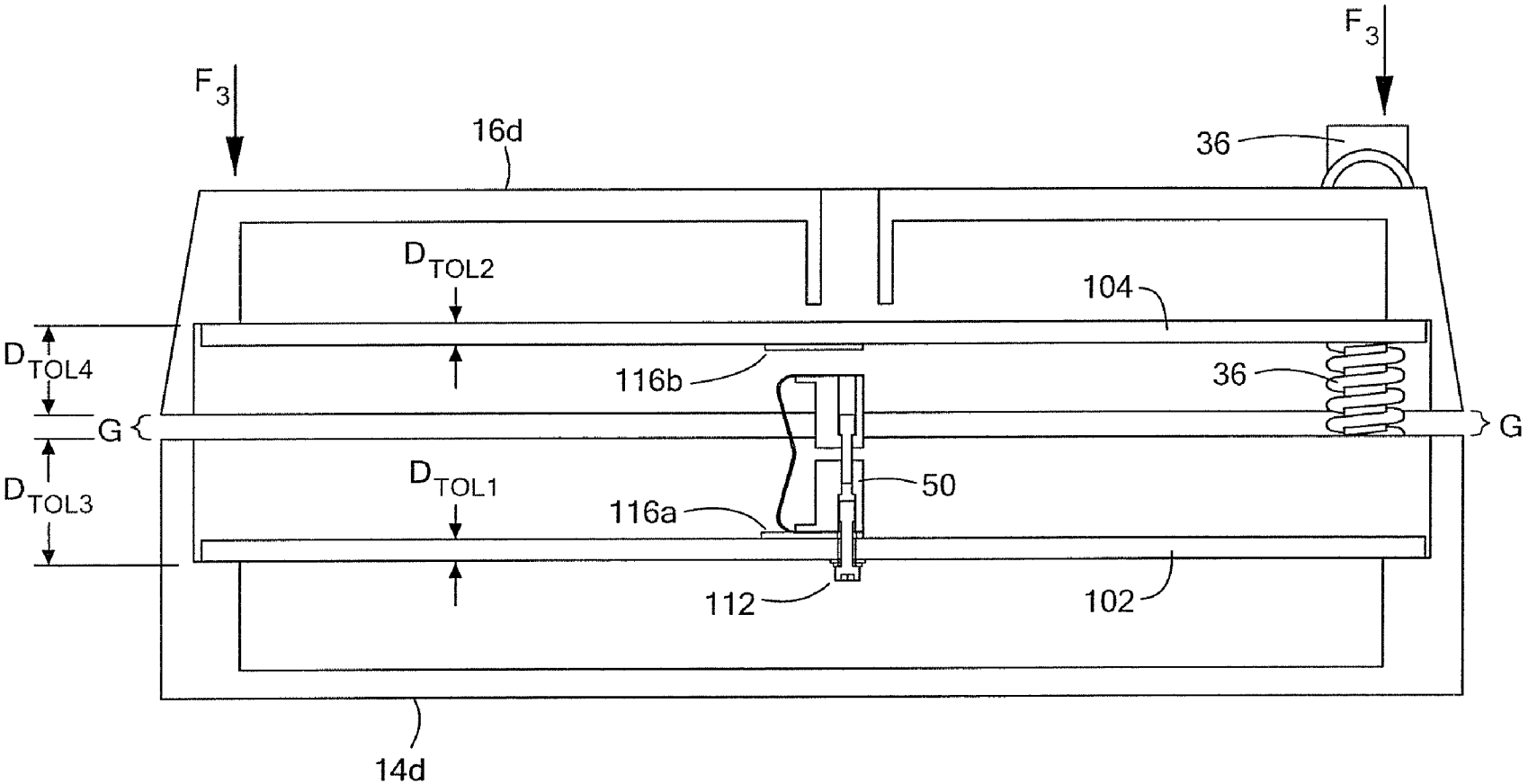
Figure 8C:
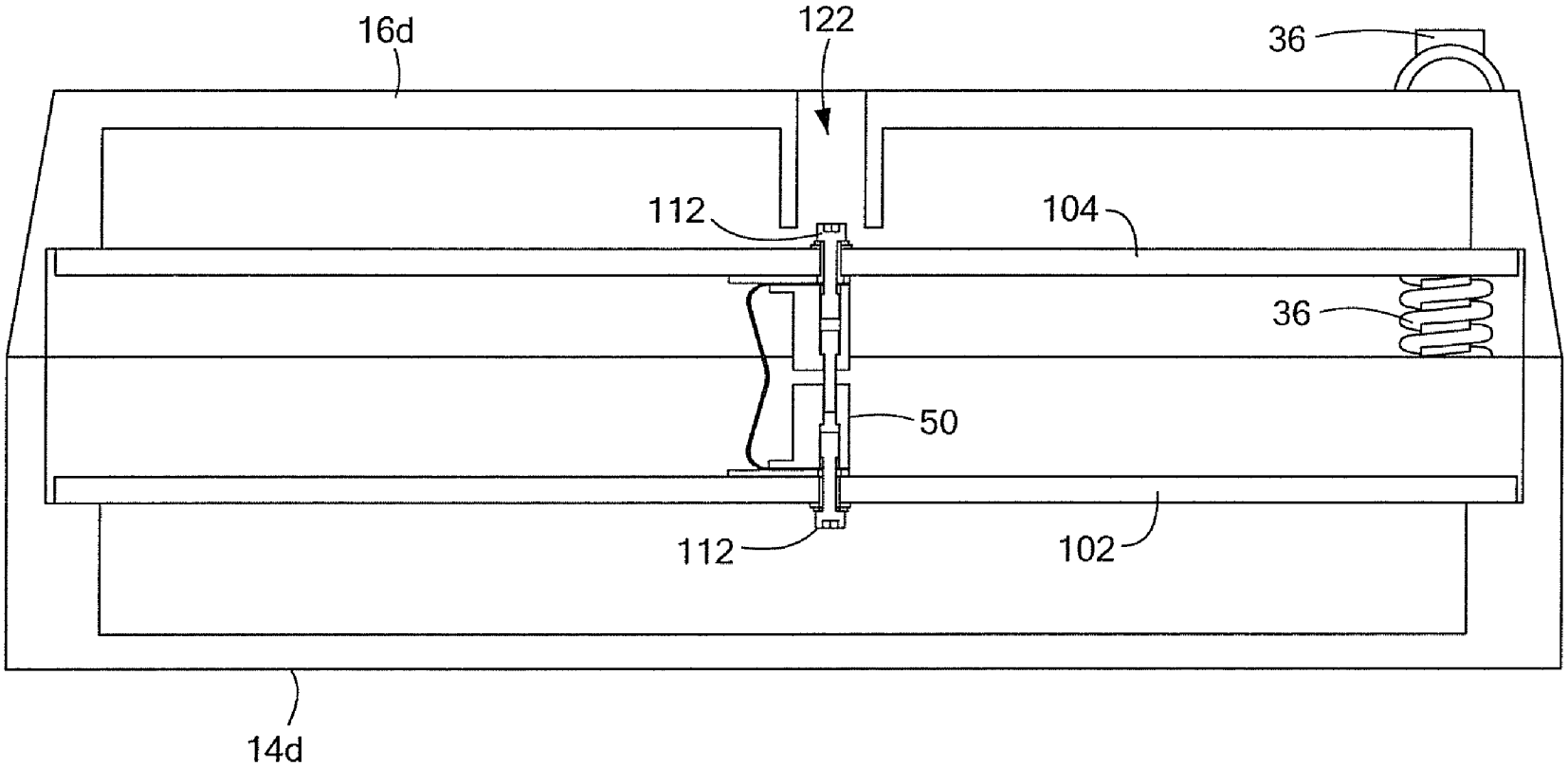

Referring to FIGS. 8A to 8C and using the LRU 20*d*, one example of a process to connect the connector 50 in the panel array subsystem 10 is to secure the connector 50 to the first circuit card 102 using fasteners 112 (FIG. 8A). The cold plate 16*d* is rotated using the hinge 36 so that the cold plate 16*d* is directly above the cold plate 14*d* leaving a gap, G (FIG. 8B). To close the gap, G, a force $F_3$ is applied on the cold plate 16*d* (FIG. 8B). Perimeter screws (not shown) are used to provide the Force, $F_3$, to close the gap, G. After the gap G is closed fasteners 112 are used to secure the connector 50 to the second circuit card 104 in the cold plate 16*d*.

Figure 9A:
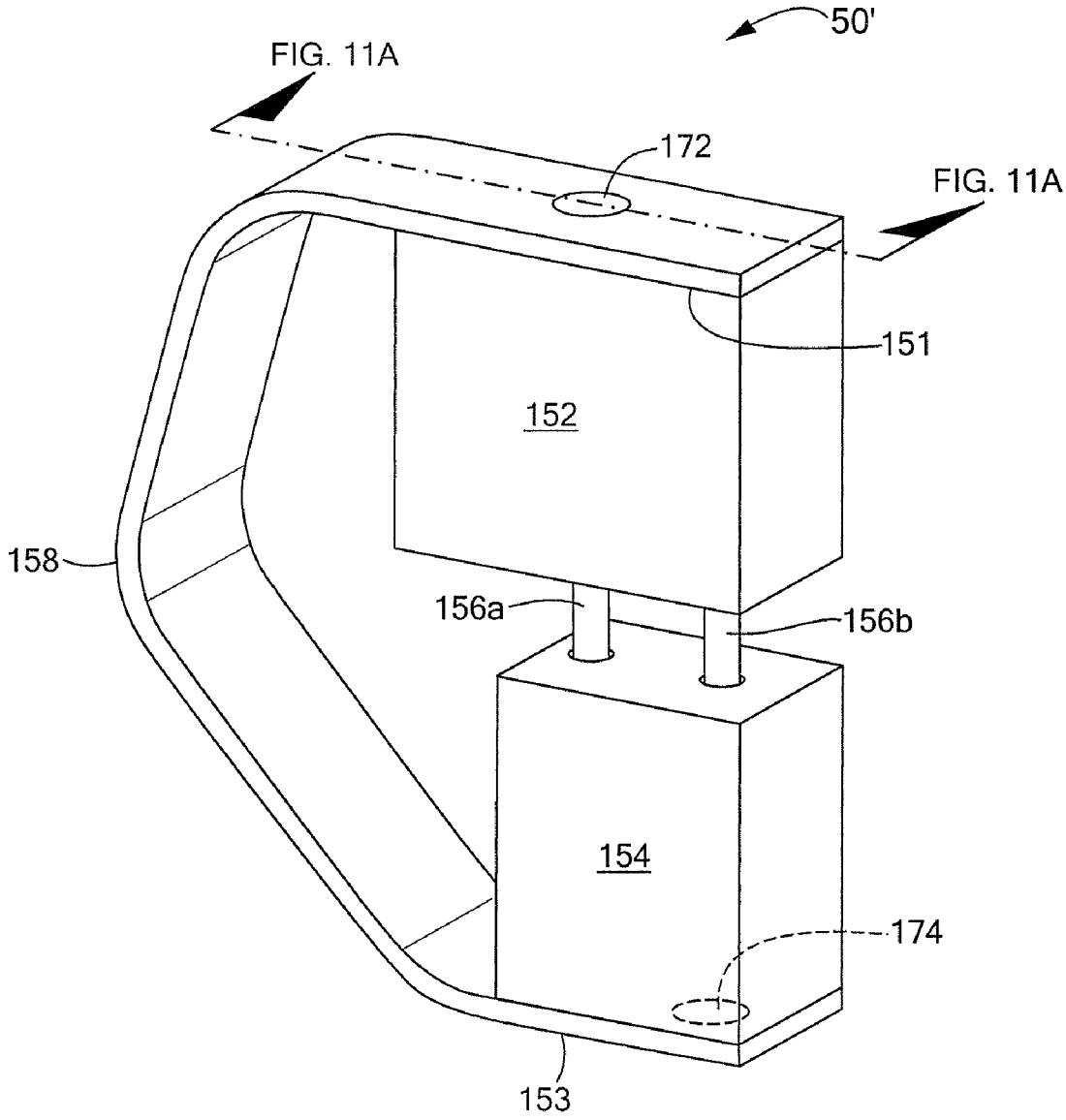
FIG. 9A is a view of another example of an electrical connector.
Figure 9B:
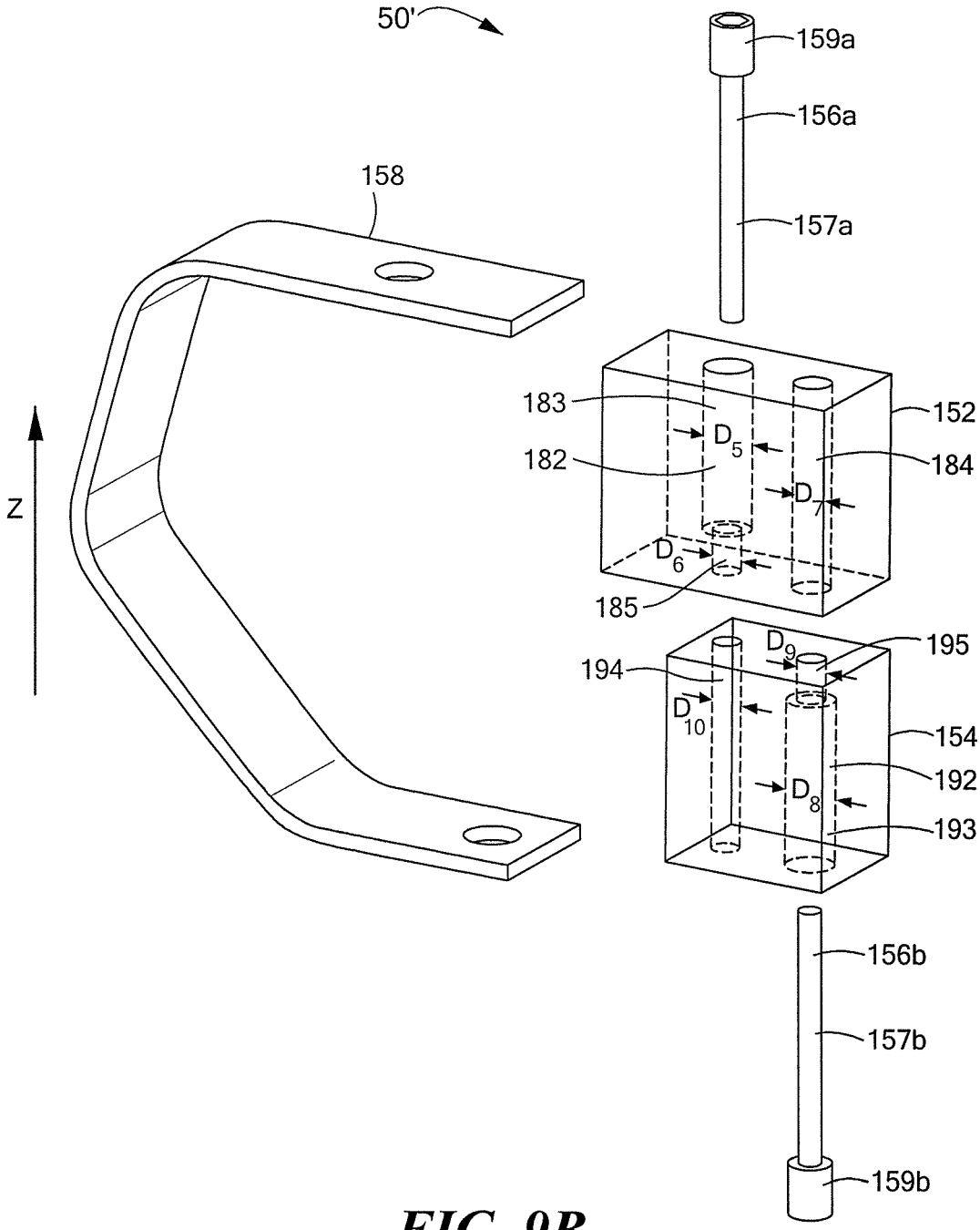
FIG. 9B is an exploded view of the electrical connector of FIG. 9A.

Referring to FIGS. 9A and 9B, another example of an electrical connector is an electrical connector 50'. In one example, the electrical connector 50' is used as a high-current connector. The electrical connector 50' includes rigid members 152, 154, alignment pins 156*a*, 156*b* and a compliant member 158. The rigid member 152 is attached to one end portion 151 of the compliant member 158 and the rigid member 154 is attached to the other end portion 153 of the compliant member 158. In one example, the rigid members 152, 154 are attached to the compliant member 158 using an epoxy or an adhesive, for example. In one example, the rigid members 152, 154 are an epoxy glass laminate such as FR-4 and G-10, for example.

The electrical connector 50' includes two apertures on the compliant member 158. An aperture 172 on the one end 151 of the compliant member 158 and a second aperture 174 on the other end 153 of the compliant member 158.

The alignment pins 156*a*, 156*b* each include a body portion and a threaded head portion (e.g., the alignment pin 156*a* includes a body portion 157*a* and a head portion 159*a* and the alignment pin 156*b* includes a body portion 157*b* and a head portion 159*b*). The alignment pins 156*a*, 156*b* are secured within a corresponding one of the rigid member 152, 154 and the body portions 157*a*, 157*b* extend along a Z-axis into the other of the rigid member 154, 152. The compliant member 158 flexes along the Z-axis and conducts electricity between its end portions 151, 153 which allows electrical signals to pass between, for example, the first and second circuit cards 102, 104 (FIG. 7).

The rigid member 152 includes bores 182, 184 to receive the alignment pins 156*a*, 156*b*. For example, the bore 182 is configured to receive the alignment pin 156*a* and the bore 184 is configured to receive the alignment pin 156*b*.

The bore 182 included two portions 183, 185. The first portion 183 is threaded and has a diameter, $D_5$, to engage the head portion 159*a* of the alignment pin 156*a*. The second portion 185 has a diameter, $D_6$, that is smaller than the diameter, $D_5$, but large enough for the body portion 157*a* of the alignment pin 156*a* to pass through. The bore 182 is sufficiently long enough to accommodate the fastener 112 (FIG. 7). The bore 184 has a first diameter, $D_7$, large enough for the body portion 157*b* of the alignment pin 156*b* to pass through. The bore 184 is sufficiently long enough to accommodate the body portion 157*b* of the alignment pin 156*b*.

The rigid member 154 includes bores 192, 194 to receive the alignment pins 156*a*, 156*b*. For example, the bore 192 is configured to receive the alignment pin 156*b* and the bore 194 is configured to receive the alignment pin 156*a*.

The bore 192 included two portions 193, 195. The first portion 193 is threaded and has a diameter, $D_8$, to engage the head portion 179*b* of the alignment pin 156*b*. The second portion 195 has a diameter, $D_9$, that is smaller than the diameter, $D_8$, but large enough for the body portion 157*b* of the alignment pin 156*b* to pass through. The bore 192 is sufficiently long enough to accommodate the fastener 112 (FIG. 7). The bore 194 has a diameter, $D_{10}$, large enough for the body portion 157*a* of the alignment pin 156*a* to pass through. The bore 194 is sufficiently long enough to accommodate the body portion 157*a* of the alignment pin 156*a*.

In one example, the diameter $D_6$ is equal to the diameter $D_{10}$. In another example, the diameter $D_7$ is equal to the diameter $D_9$.

Figure 10A:
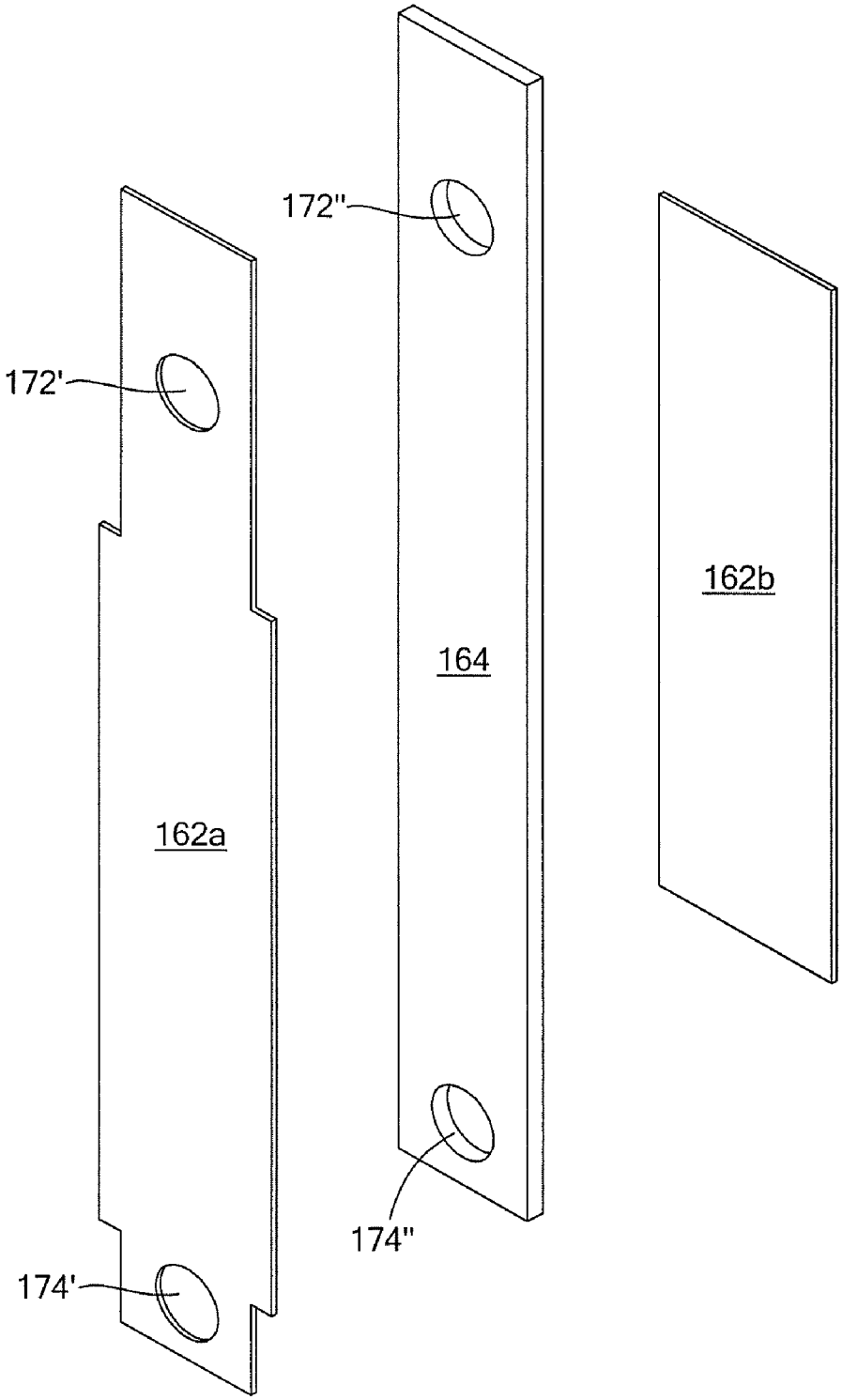
FIG. 10A is an exploded view of a compliant element for the connector in FIG. 9A.
Figure 10B:
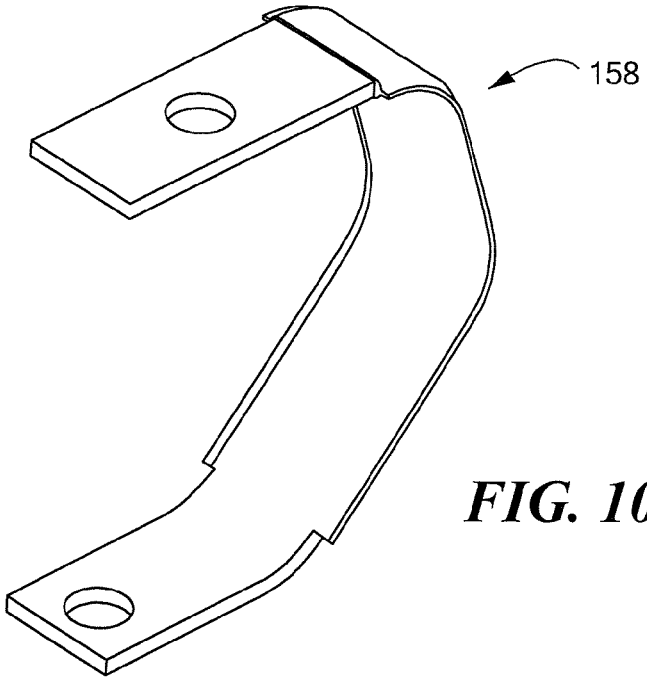
FIGS. 10B and 10C are views of the compliant member of the connector in FIG. 9A.
Figure 10C:
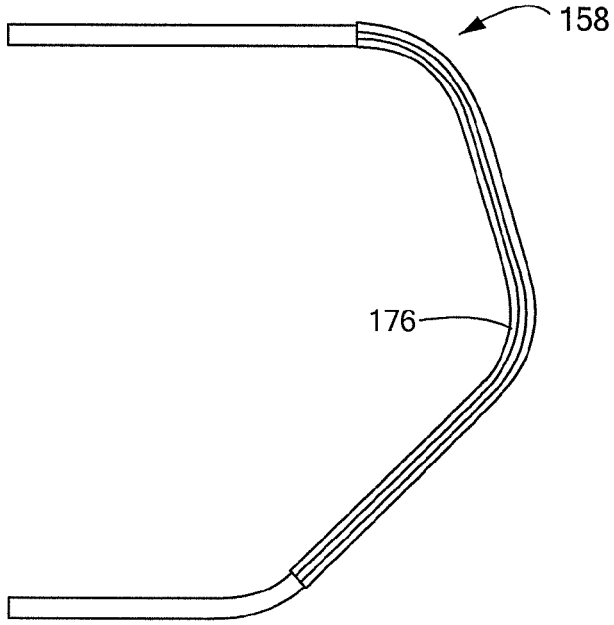

Referring to FIGS. 10A to 10C, the compliant member 50 includes a first insulator layer 162*a*, an electrically conductive layer 164*a* and a second insulator layer 62*b*. The electrically conductive layer 164 includes apertures 172", 174" and the first insulator layer 162*a* includes apertures 172', 174'. When the layers 162*a*, 164, 162*b* are combined the apertures 172', 172" form the aperture 172 and the apertures 174', 174" form the aperture 174.

In one example, the insulator layers 162*a*, 162*b* protect the electrically conductive layer 164 respectively from external damage such as nicks and scratches. Generally, in fabricating the compliant member 158, the insulator layers 162*a*, 162*b* and the electrically conductive layer 164 are flat initially and subsequently bent and shaped. For example, the compliant member 158 is shaped to include a flex point 176 so that the compliant member may flex in the Z-axis. In one example, the electrically conductive layer 164 is a metal layer such as copper, aluminum and so forth. In one example, the insulator layers 162*a*, 162*b* are polyimide laminate layers.

Figure 11B:
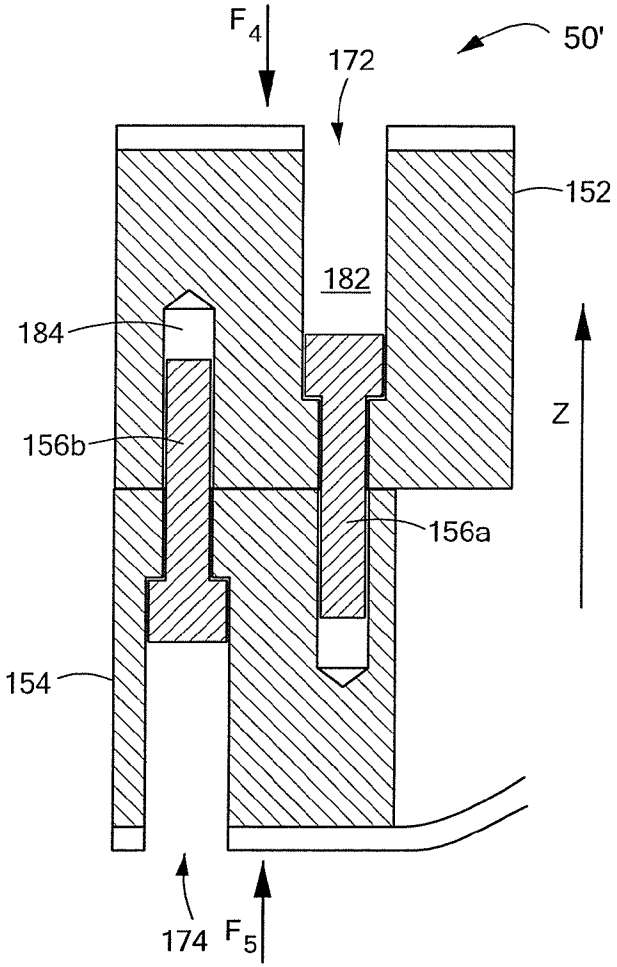
FIG. 11B is another cross-sectional view of the electrical connector of FIG. 9A with the connector flexed.
Figure 11A:
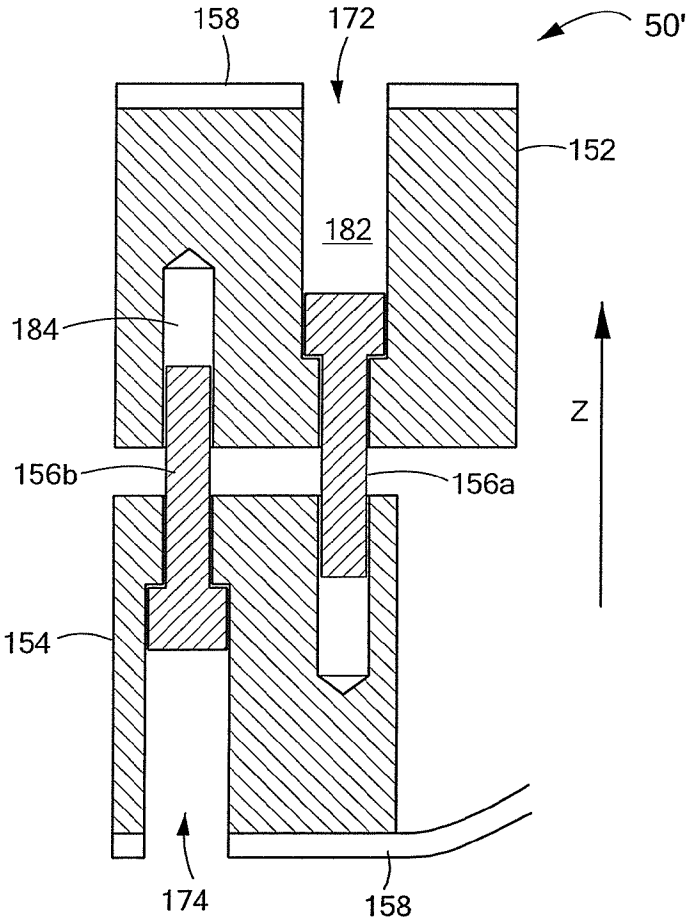
FIG. 11A is a cross-sectional view of the electrical connector in FIG. 9A taken along the line 11A-11A.

Referring to FIGS. 11A and 11B, in one example, the alignment pin 156*a* is installed into the connector 50' by passing the alignment pin 156*a* through the aperture 172 and through the bore 182 and is screwed into the first portion 183 of the bore 182 so that the head portion 159*a* of the alignment pin 156*a* is secured tight. The body portion 157*a* of the alignment pin 156*a* extends through the second portion 185 of the bore 182 into the bore 194 of the rigid member 154.

The alignment pin 156*b* is installed into the connector 50' by passing the alignment pin 156*b* through the aperture 174 and is screwed into the first portion 193 of the bore 192 so that the head portion 159*b* of the alignment pin 156*b* is secured tight. The body portion 157*b* of the alignment pin 156*b* extends through the second portion 195*b* of the bore 192 into the bore 184 of the rigid member 152.

When a force $F_4$ is applied to one end of the connector 50' and an equal force $F_5$ is applied to the opposite end of the connector, the compliant member 158 bends at the flex point 176 until the rigid members 52*a*, 52*b* are in contact (FIG. 11B). Therefore, the rigid members 52*a*, 52*b* act as mechanical stops.

Figure 12B:
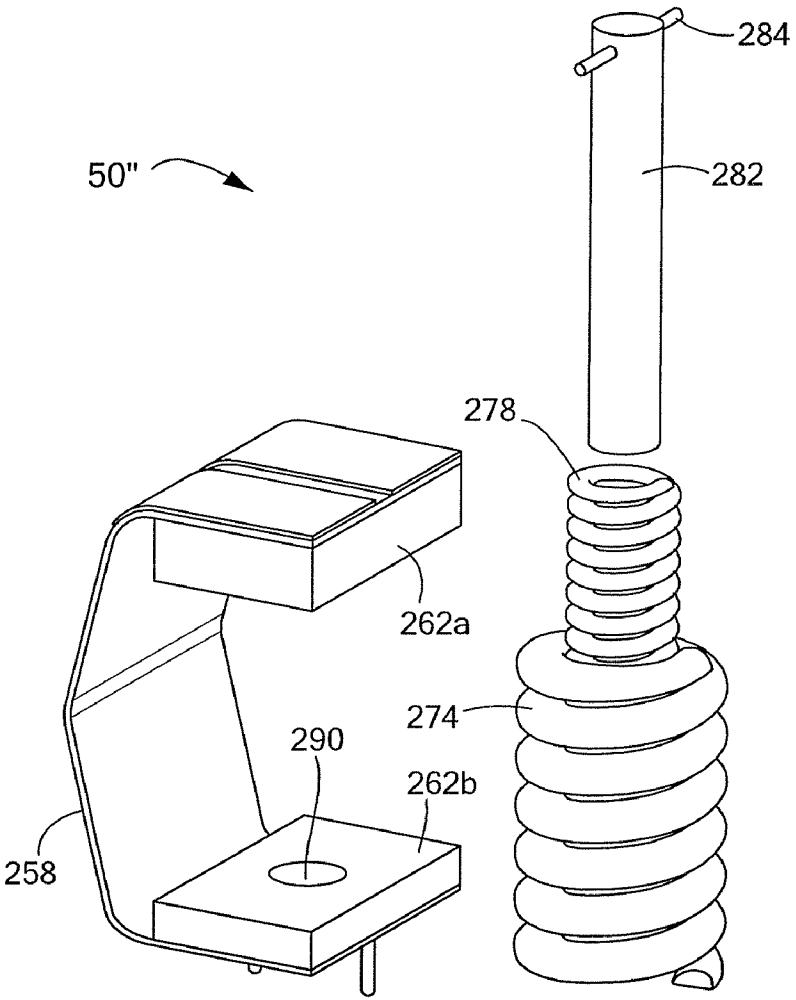
FIG. 12B is an exploded view of the electrical connector of FIG. 12A.
Figure 12A:
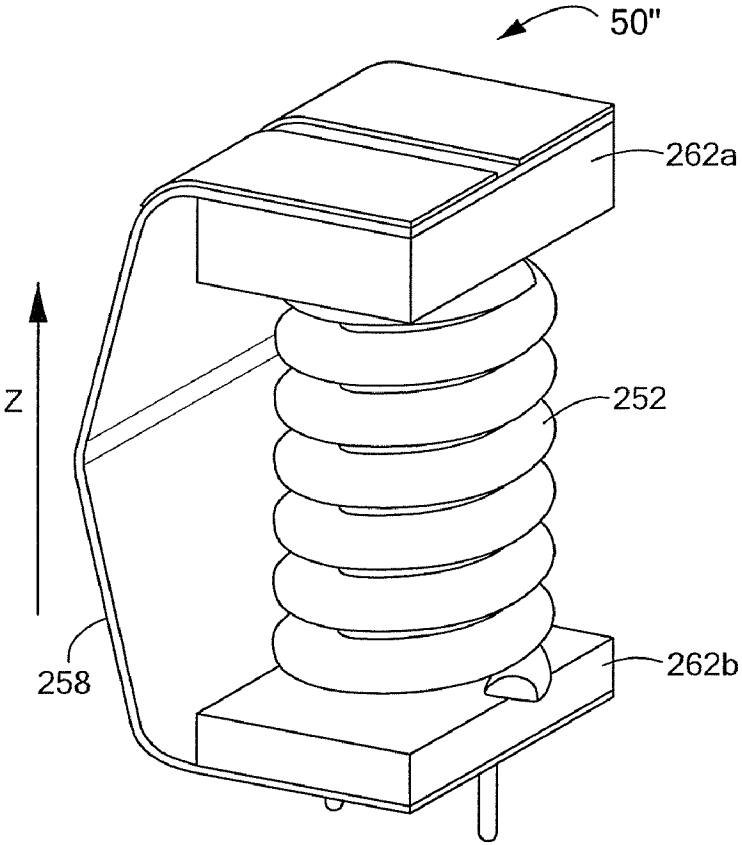
FIG. 12A is a view of a further example of an electrical connector.

Referring to FIGS. 12A and 12B, another example of an electrical connector is an electrical connector 50". The connector 50" includes nested spring assembly 252, a compliant member 258, and rigid members 262*a*, 262*b*. The nested spring assembly 252 includes a first spring 274 and a second spring 278 nested within the first spring. A pin 282 runs through the centers of the first and second springs 274, 278 in a Z direction and includes a pin 284. The pin 282 is connected in a cavity 290 of the rigid member 262*b* and is securely attached in a cavity (not shown) in the rigid member 262*a* using the pin 284. The springs 274, 278 are selected to provide adequate force on electrical surfaces (e.g., electrical pads 116*a*, 116*b* (FIG. 7) and the compliant member 258). One of ordinary skill in the art would understand how to select the appropriate springs 274, 278 and understand that the nested spring assembly 252 may be replaced by a single spring.

The nested spring assembly 252 provides the compression force required for a low electrical contact resistance interface, replacing a need for any additional hardware such as alignment pins (e.g., alignment pins, 56*a*, 56*b*, 156*a*, 156*b*) or fasteners 112 in the electrical connectors 50, 50'. The connector 50" reduces the average maintenance cycle time and eliminates foreign object debris (i.e., loose hardware) that could possibly be misplaced and damage sensitive electronics.

In other examples, one or more of the electrical connectors 50, 50', 50" described herein may be fabricated using different amounts of alignment pins, fastening methods and so forth to achieve the results set forth above.

Elements of different embodiments described herein may be combined to form other embodiments not specifically set forth above. Other embodiments not specifically described herein are also within the scope of the following claims.

What is claimed is:

1. An electrical connector to connect circuit cards comprising:

a compliant member comprising a first end portion and a second end portion;

a first rigid member attached to the first end portion of the compliant member and comprising a first bore extending along an axis;

a second rigid member attached to the second end portion of the compliant member and comprising a second bore extending along the axis; and a pin secured in the first bore and configured to move within the second bore;

wherein the compliant member is configured to translate along the axis from a first position corresponding to the first and second rigid members being separated to a second position corresponding to the first and second rigid members being in direct contact.

2. The electrical connector of claim 1, wherein the pin moves within the second bore as the compliant member translates from the first position to the second position.

3. The electrical connector of claim 1 wherein the first rigid member further comprises a third bore and the second rigid member further comprises a fourth bore, and wherein the pin is a first pin, and further comprising a second pin secured in the fourth bore and configured to move within the third bore.

4. The electrical connector of claim 3 wherein the compliant member comprises a first aperture aligned with the first bore and a second aperture aligned with the fourth bore, wherein the first bore is configured to receive a first fastener to secure the connector to a first circuit card, wherein the fourth bore is configured to receive a second fastener to secure the connector to a second circuit card.

5. The electrical connector of claim 4 wherein the first circuit card and the second circuit card are spaced apart in an electrical connection.

6. The electrical connector of claim 4 wherein the first circuit card and the second circuit card are substantially parallel to each other in an electrical connection.

7. The electrical connector of claim 1 wherein the compliant member comprises a first aperture aligned with the first bore and a second aperture aligned with the second bore, wherein the first bore is configured to receive a first fastener to secure the connector to a first circuit card, wherein the second bore is configured to receive a second fastener to secure the connector to a second circuit card.

8. The electrical connector of claim 7 wherein the compliant member further comprises a third aperture aligned with the third bore and a fourth aperture aligned with the fourth bore, wherein the third bore is configured to receive a third fastener to secure the connector to the first circuit card, wherein the fourth bore is configured to receive a fourth fastener to secure the connector to the second circuit card.

9. The electrical connector of claim 1 wherein the compliant member comprises an electrically conductive layer.

10. The electrical connector of claim 9 wherein the electrically conductive layer comprises copper.

11. The electrical connector of claim 9 wherein the compliant member further comprises a first insulator layer disposed on a first surface of the electrically conductive layer and a second insulator layer disposed on a second surface of the electrically conductive layer opposite the first surface of the electrically conductive layer.

12. The electrical connector of claim 9 wherein the first insulator layer comprises a polyimide layer.

13. The electrical connector of claim 9 wherein the electrically conductive layer is a first electrically conductive layer and, wherein the compliant member further comprises a second electrically conductive layer.

14. The electrical connector of claim 13 wherein the compliant member further comprises a first insulator layer, a second insulator layer and a third insulator layer, wherein the first insulator layer is disposed on a first surface of the first electrically conductive layer and the second insulator layer is disposed on a second surface of the first electrically conductive layer opposite the first surface of the first electrically conductive layer, and wherein the second insulator layer is disposed on a first surface of the second electrically conductive layer and the third insulator layer is disposed on a second surface of the second electrically conductive layer opposite the first surface of the second electrically conductive layer.

15. The electrical connector of claim 1 wherein the pin comprises threads and the first bore comprises threads to engage the threads of the alignment pin.

16. The electrical connector of claim 1 wherein the pin comprises a body and a head each comprising threads.

17. The electrical connector of claim 16 wherein the first bore comprises a first portion having a first diameter and a second portion comprising a second diameter smaller than the first diameter.

18. An electrical connector to connect circuit cards comprising:

a compliant member comprising a first end portion and a second end portion;

a spring assembly extending along an axis and configured to translate along the axis; the spring assembly forming a cavity extending along the axis; and a pin configured to pass through the cavity and to engage the first end portion and the second end portion;

wherein the compliant member is configured to translate along the axis from a first position to a second position.

19. The electrical connector of claim 18 wherein the spring assembly comprises nested springs.

20. The electrical connector of claim 18 wherein the compliant member comprises:

an electrically conductive layer;

a first insulator layer disposed on a first surface of the electrically conductive layer; and a second insulator layer disposed on a second surface of the electrically conductive layer opposite the first surface of the electrically conductive layer.

21. The electrical connector of claim 20 wherein the electrically conductive layer is a first electrically conductive layer and, wherein the compliant member further comprises a second electrically conductive layer;

a third insulator layer, wherein the second insulator layer is disposed on a first surface of the second electrically conductive layer and the third insulator layer is disposed on a second surface of the second electrically conductive layer opposite the first surface of the second electrically conductive layer.

22. A system comprising:

a line replaceable unit comprising:

panels configured to provide radio frequency signals and disposed on an exterior surface of the line replaceable unit;

electrical circuitry disposed in an interior of the line replaceable unit, the circuitry comprising:

a first circuit card;

a second circuit card; and a connector electrically connecting the first circuit card to the second circuit card, the connector comprising:

a compliant member comprising a first end portion and a second end portion;

a first rigid member attached to the first end portion of the compliant member and comprising a first bore extending along an axis;

a second rigid member attached to the second end portion of the compliant member and comprising a second bore extending along the axis; and a pin secured in the first bore and configured to move within the second bore;

wherein the compliant member is configured to translate along the axis from a first position corresponding to the first and second rigid members being separated to a second position corresponding to the first and second rigid members being in direct contact.

23. The system of claim 22 wherein the compliant member comprises:

an electrically conductive layer;

a first insulator layer disposed on a first surface of the electrically conductive layer; and a second insulator layer disposed on a second surface of the electrically conductive layer opposite the first surface of the electrically conductive layer.

24. The system of claim 23 wherein the electrically conductive layer is a first electrically conductive layer and, wherein the compliant member further comprises:

a second electrically conductive layer; and a third insulator layer, wherein the second insulator layer is disposed on a first surface of the second electrically conductive layer and the third insulator layer is disposed on a second surface of the second electrically conductive layer opposite the first surface of the second electrically conductive layer.

25. The system of claim 22 wherein the first rigid member further comprises a third bore and the second rigid member further comprises a fourth bore, and wherein the pin is a first pin, and further comprising a second pin secured in the fourth bore and configured to move within the third bore.

26. The electrical connector of claim 22 wherein the first circuit card and the second circuit card are spaced apart in an electrical connection.

27. The electrical connector of claim 22 wherein the first circuit card and the second circuit card are substantially parallel to each other in an electrical connection.

28. An electrical connector to connect circuit cards comprising:

a compliant member comprising a first end portion and a second end portion and further comprising:

an electrically conductive layer, a first insulator layer disposed on a first surface of the electrically conductive layer; and a second insulator layer disposed on a second surface of the electrically conductive layer opposite the first surface of the electrically conductive layer;

a first rigid member attached to the first end portion of the compliant member and comprising a first bore extending along an axis;

a second rigid member attached to the second end portion of the compliant member and comprising a second bore extending along the axis; and a pin secured in the first bore and configured to move within the second bore, wherein the compliant member is configured to translate along the axis from a first position corresponding to the first and second rigid members being separated to a second position corresponding to the first and second rigid members being in direct contact, wherein the compliant member further includes a first aperture aligned with the first bore and a second aperture aligned with the second bore, wherein the first bore is configured to receive a first fastener through the first aperture to secure the connector to a first circuit card, and wherein the second bore is configured to receive a second fastener through the second aperture to secure the connector to a second circuit card.

29. The electrical connector of claim 28 wherein the electrically conductive layer is a first electrically conductive layer and, wherein the compliant member further comprises:

a second electrically conductive layer; and a third insulator layer, wherein the second insulator layer is disposed on a first surface of the second electrically conductive layer and the third insulator layer is disposed on a second surface of the second electrically conductive layer opposite the first surface of the second electrically conductive layer.

30. The system of claim 28 wherein the first rigid member further comprises a third bore and the second rigid member further comprises a fourth bore, and wherein the pin is a first pin, and further comprising a second pin secured in the fourth bore and configured to move within the third bore.

31. A method to connect circuit cards, comprising:

providing an electrical connector comprising:

a compliant member comprising a first end portion having a first aperture and a second end portion having a second aperture and further comprising:

an electrically conductive layer, a first insulator layer disposed on a first surface of the electrically conductive layer; and a second insulator layer disposed on a second surface of the electrically conductive layer opposite the first surface of the electrically conductive layer;

a first rigid member attached to the first end portion of the compliant member and comprising a first bore extending along an axis;

a second rigid member attached to the second end portion of the compliant member and comprising a second bore extending along the axis; and a pin secured in the first bore and configured to move within the second bore, using a first fastener to connect the compliant member of the electrical connector to a first circuit card; and using a second fastener to connect the electrical connector to a second circuit card spaced apart from the first circuit card, wherein the compliant member is configured to translate along the axis from a first position corresponding to the first and second rigid members being separated to a second position corresponding to the first and second rigid members being in direct contact.

32. The method of claim 31 wherein using a first fastener to electrically connect the compliant member of the electrical connector to a first circuit card comprises screwing a screw into the first bore.

33. The method of claim 31 wherein using a second fastener to electrically connect the compliant member of the electrical connector to a second circuit card comprises screwing a screw into the second rigid member.

* * * * *

UNITED STATES PATENT AND TRADEMARK OFFICE

CERTIFICATE OF CORRECTION

PATENT NO. : 7,690,924 B1
APPLICATION NO. : 12/421262
DATED : April 6, 2010
INVENTOR(S) : Paquette et al.

It is certified that error appears in the above-identified patent and that said Letters Patent is hereby corrected as shown below:

Col. 2, line 59, delete "FIG. 3B an" and replace with -- FIG. 3B is an --.

Col. 4, line 11, delete "array 11" and replace with -- array antenna 11 --.

Col. 4, line 38, delete "system" and replace with -- subsystem --.

Col. 5, line 4, delete "array 11" and replace with -- array antenna 11 --.

Col. 5, line 8, delete "dispose" and replace with -- disposed --.

Col. 5, line 9, delete "system" and replace with -- subsystem --.

Col. 5, line 24, delete "electronics 24" and replace with -- electronics 28 --.

Col. 5, line 56, delete "4" and replace with -- 3B --.

Col. 6, line 37, delete "74a" and replace with -- 74b --.

Col. 6, line 43, delete "member" and replace with -- members --.

Col. 6, line 45, delete "member" and replace with -- members --.

Col. 6, line 64, delete "insulation" and replace with -- insulator --.

Col. 7, line 43, delete "87a" and replace with -- 84a --.

Col. 7, line 46, delete "$D_3$" and replace with -- $D_4$ --.

Col. 8, line 15, delete "second card 104" and replace with -- second circuit card 104 --.

Col. 9, line 8, delete "member" and replace with -- members --.

Col. 9, line 10, delete "rigid member" and replace with -- rigid members --.

Col. 9, line 36, delete "179b" and replace with -- 159b --.

Col. 9, line 49, delete "50" and replace with -- 158 --.

Col. 9, line 51, delete "164a" and replace with -- 164 --.

Col. 9, line 51, delete "62b." and replace with -- 162b. --.

Signed and Sealed this

First Day of June, 2010

David J. Kappos

David J. Kappos
*Director of the United States Patent and Trademark Office*

Col. 10, line 19, delete “52a, 52b” and replace with -- 152, 154 --.

Col. 10, line 20, delete “52a, 52b” and replace with -- 152, 154 --.